US008368636B2

(12) United States Patent
Shteynberg et al.

(10) Patent No.: US 8,368,636 B2
(45) **Date of Patent: *Feb. 5, 2013**

(54) REGULATION OF WAVELENGTH SHIFT AND PERCEIVED COLOR OF SOLID STATE LIGHTING WITH INTENSITY VARIATION

(75) Inventors: Anatoly Shteynberg, San Jose, CA (US); Harry Rodriguez, Gilroy, CA (US); Bradley M. Lehman, Belmont, MA (US); Dongsheng Zhou, San Jose, CA (US)

(73) Assignee: Point Somee Limited Liability Company, Dover, DE (US)

( * ) Notice: Subject to any disclaimer, the term of this patent is extended or adjusted under 35 U.S.C. 154(b) by 1454 days.

This patent is subject to a terminal disclaimer.

(21) Appl. No.: 11/927,084

(22) Filed: Oct. 29, 2007

(65) Prior Publication Data

US 2009/0079357 A1 Mar. 26, 2009

Related U.S. Application Data

(63) Continuation-in-part of application No. 11/859,680, filed on Sep. 21, 2007, now Pat. No. 7,880,400.

(51) Int. Cl.
*G09G 3/36* (2006.01)

(52) U.S. Cl. ..... 345/102; 345/204; 345/212; 345/211; 345/214

(58) Field of Classification Search ..... 315/291, 315/307–326, 247, 185 S; 345/102, 204, 345/211, 212, 213, 214

See application file for complete search history.

(56) References Cited

U.S. PATENT DOCUMENTS

| | | | |
|---|---|---|---|
| 5,026,978 | A | 6/1991 | Misumi |
| 5,719,474 | A | 2/1998 | Vitello |
| 5,994,844 | A | 11/1999 | Crawford |
| 6,016,038 | A | 1/2000 | Mueller |
| 6,150,774 | A | 11/2000 | Mueller |
| 6,211,626 | B1 | 4/2001 | Lys |
| 6,340,868 | B1 | 1/2002 | Lys |
| 6,469,457 | B2 | 10/2002 | Callahan |
| 6,528,934 | B1 | 3/2003 | Chen |
| 6,636,003 | B2 | 10/2003 | Rahm |
| 6,731,079 | B2 | 5/2004 | Andersen |
| 6,788,011 | B2 | 9/2004 | Mueller |
| 6,801,003 | B2 | 10/2004 | Schanberger |
| 6,806,659 | B1 | 10/2004 | Mueller |

(Continued)

OTHER PUBLICATIONS

Lumileds Application Brief AB27, "For LCD Backlighting Luxeon DCC," Jan. 2005, <http://www.philipslumileds.com/support/documentation/application-briefs>, pp. 1-38.

(Continued)

*Primary Examiner* — Tuyet Thi Vo
(74) *Attorney, Agent, or Firm* — Christensen O'Connor Johnson Kindness PLLC

(57) ABSTRACT

Representative embodiments of the invention provide a system, apparatus, and method of controlling an intensity and spectrum of light emitted from a solid state lighting system. The solid state lighting system has a first emitted spectrum at a full intensity level and at a selected temperature, with a first electrical biasing for the solid state lighting system producing a first wavelength shift, and a second electrical biasing for the solid state lighting system producing a second, opposing wavelength shift. Representative embodiments provide for receiving information designating a selected intensity level or a selected temperature; and providing a combined first electrical biasing and second electrical biasing to the solid state lighting system to generate emitted light having the selected intensity level and having a second emitted spectrum within a predetermined variance of the first emitted spectrum over a predetermined range of temperatures.

21 Claims, 16 Drawing Sheets

U.S. PATENT DOCUMENTS

| | | | |
|---|---|---|---|
| 6,975,079 | B2 | 12/2005 | Lys |
| 6,987,787 | B1 | 1/2006 | Mick |
| 7,014,336 | B1 | 3/2006 | Ducharme |
| 7,038,398 | B1 | 5/2006 | Lys |
| 7,038,399 | B2 | 5/2006 | Lys |
| 7,081,722 | B1 | 7/2006 | Huynh |
| 7,088,059 | B2 | 8/2006 | McKinney |
| 7,135,824 | B2 | 11/2006 | Lys |
| 7,161,311 | B2 | 1/2007 | Mueller |
| 7,208,713 | B2 | 4/2007 | Ishiguchi |
| 7,598,685 | B1 | 10/2009 | Shteynberg |
| 7,863,829 | B2 | 1/2011 | Sayers |
| 7,898,187 | B1 | 3/2011 | Mei |
| 2001/0033252 | A1 | 10/2001 | Yamazaki |
| 2002/0101395 | A1 | 8/2002 | Inukai |
| 2002/0153851 | A1 | 10/2002 | Morgan |
| 2003/0214725 | A1 | 11/2003 | Akiyama |
| 2004/0245941 | A1 | 12/2004 | Schrodinger |
| 2005/0134197 | A1 | 6/2005 | Lee |
| 2005/0225264 | A1 | 10/2005 | Kemp |
| 2005/0237284 | A1 | 10/2005 | Yaguma |
| 2006/0202630 | A1 | 9/2006 | Yamada |
| 2006/0273236 | A1 | 12/2006 | Gutbrod |
| 2007/0001587 | A1 | 1/2007 | Hatwar |
| 2007/0001588 | A1 | 1/2007 | Boroson |
| 2007/0024213 | A1 | 2/2007 | Shteynberg |
| 2007/0103086 | A1 | 5/2007 | Neudorf |
| 2007/0194210 | A1 | 8/2007 | Lee |
| 2007/0267978 | A1 | 11/2007 | Shteynberg |
| 2008/0012804 | A1 | 1/2008 | Kim |
| 2009/0079358 | A1 | 3/2009 | Shteynberg |
| 2009/0079362 | A1 | 3/2009 | Shteynberg |
| 2009/0189547 | A1 | 7/2009 | Spartano |
| 2009/0236994 | A1 | 9/2009 | Deurenberg |
| 2009/0322234 | A1 | 12/2009 | Chen |
| 2010/0164403 | A1 | 7/2010 | Liu |
| 2011/0115394 | A1 * | 5/2011 | Shteynberg et al. ..... 315/250 |

OTHER PUBLICATIONS

International Search Report mailed Nov. 19, 2008, issued in International Application No. PCT/US2008/076552, filed Sep. 16, 2008, 1 pages.

International Search Report mailed Dec. 1, 2008, issued in International Application No. PCT/US2008/076587, filed Sep. 17, 2008, 2 pages.

* cited by examiner

FIG. 3A
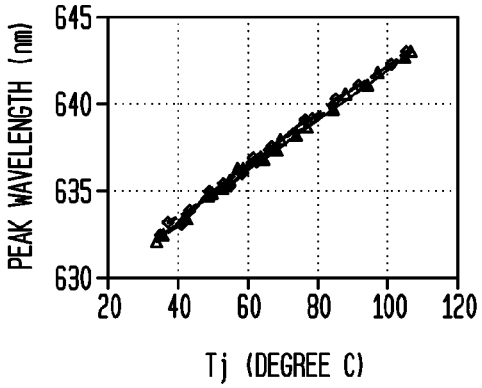
FIG. 3B
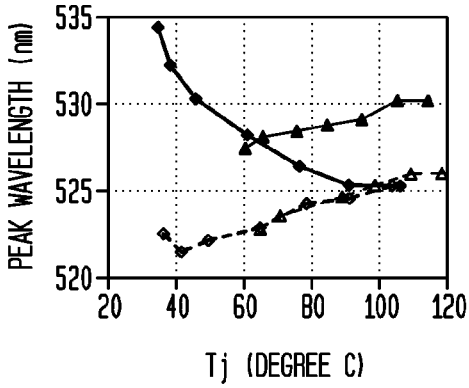
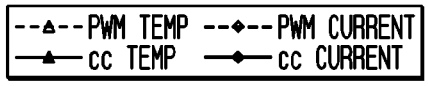
FIG. 4
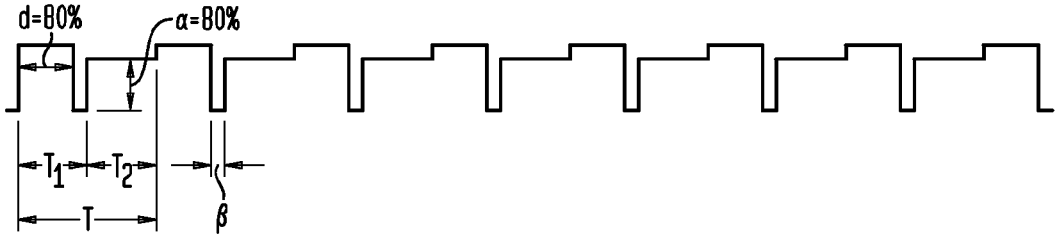
FIG. 5
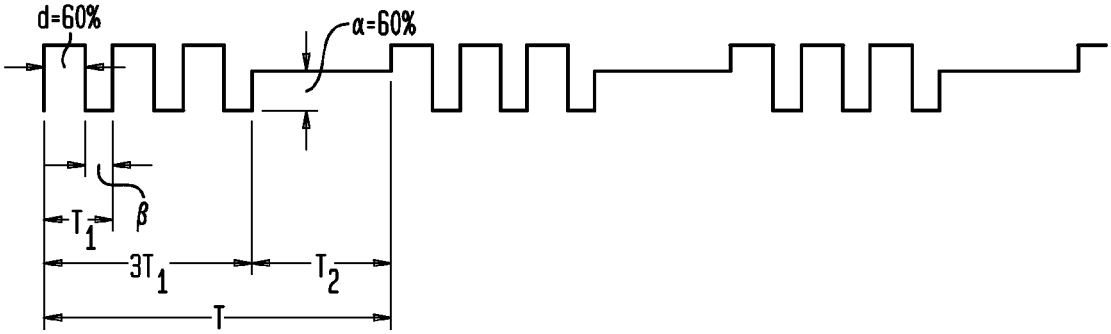

FORWARD BIASING (V OR I)

FORWARD BIASING (V OR I)

FORWARD BIASING (V OR I) FAST SWITCHING

FORWARD BIASING (V OR I)

FORWARD BIASING (V OR I)

FORWARD BIASING, ANY AC SUPERIMPOSED ON DC

FORWARD BIASING, ANY AC SUPERIMPOSED ON DC

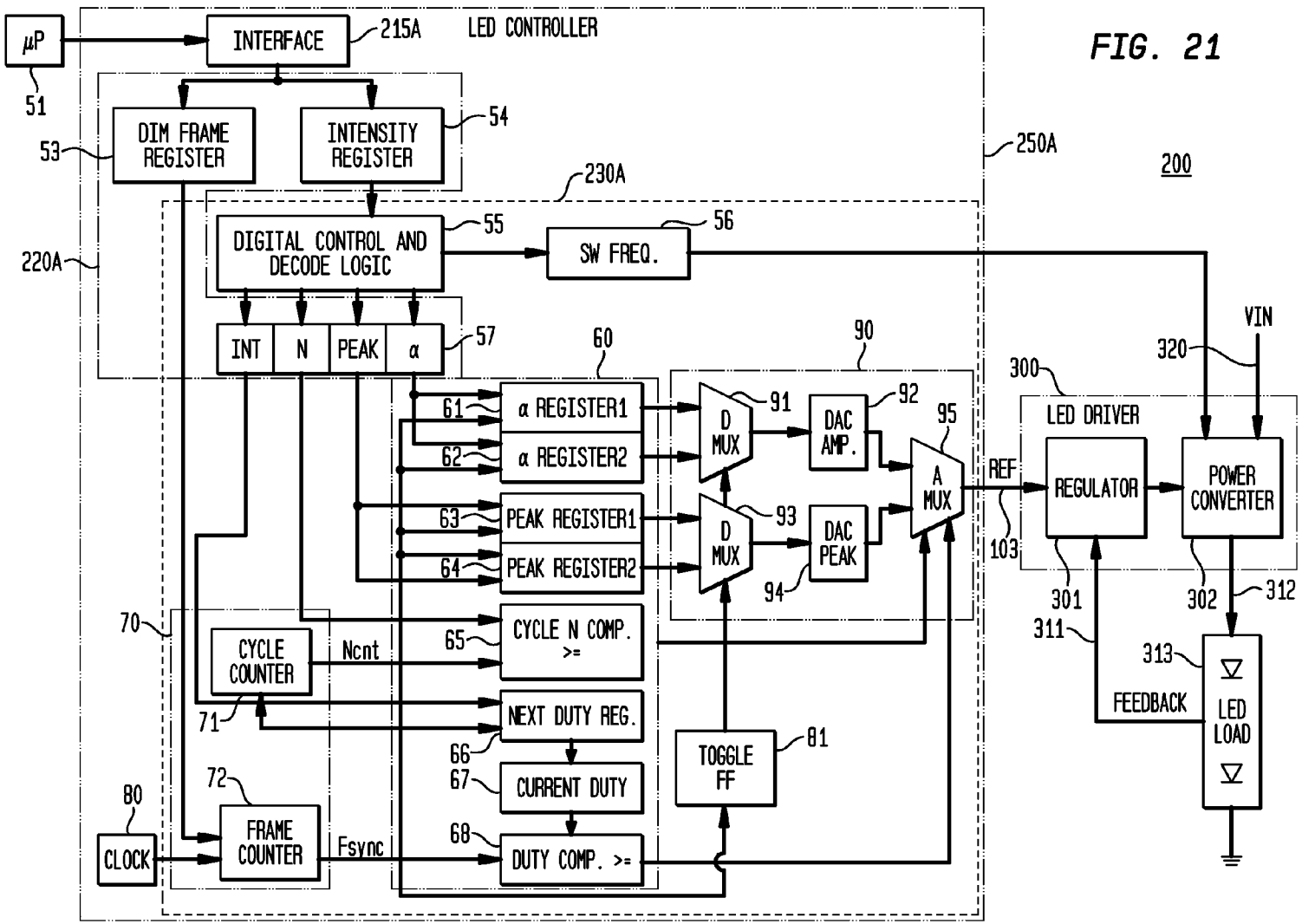
FIG. 21
200
LED CONTROLLER
250A
230A
220A
μP
51
INTERFACE
215A
INTENSITY REGISTER
54
DIM FRAME REGISTER
53
DIGITAL CONTROL AND DECODE LOGIC
55
SW FREQ.
56
INT
N
PEAK
α
57
α REGISTER1
α REGISTER2
PEAK REGISTER1
PEAK REGISTER2
CYCLE N COMP. >=
NEXT DUTY REG.
CURRENT DUTY
DUTY COMP. >=
60
61
62
63
64
65
66
67
68
CYCLE COUNTER
71
FRAME COUNTER
72
70
Ncnt
Fsync
CLOCK
80
D MUX
91
D MUX
93
DAC AMP.
92
DAC PEAK
94
90
A MUX
95
TOGGLE FF
81
REF
103
VIN
320
POWER CONVERTER
302
312
LED DRIVER
300
REGULATOR
301
311
FEEDBACK
313
LED LOAD

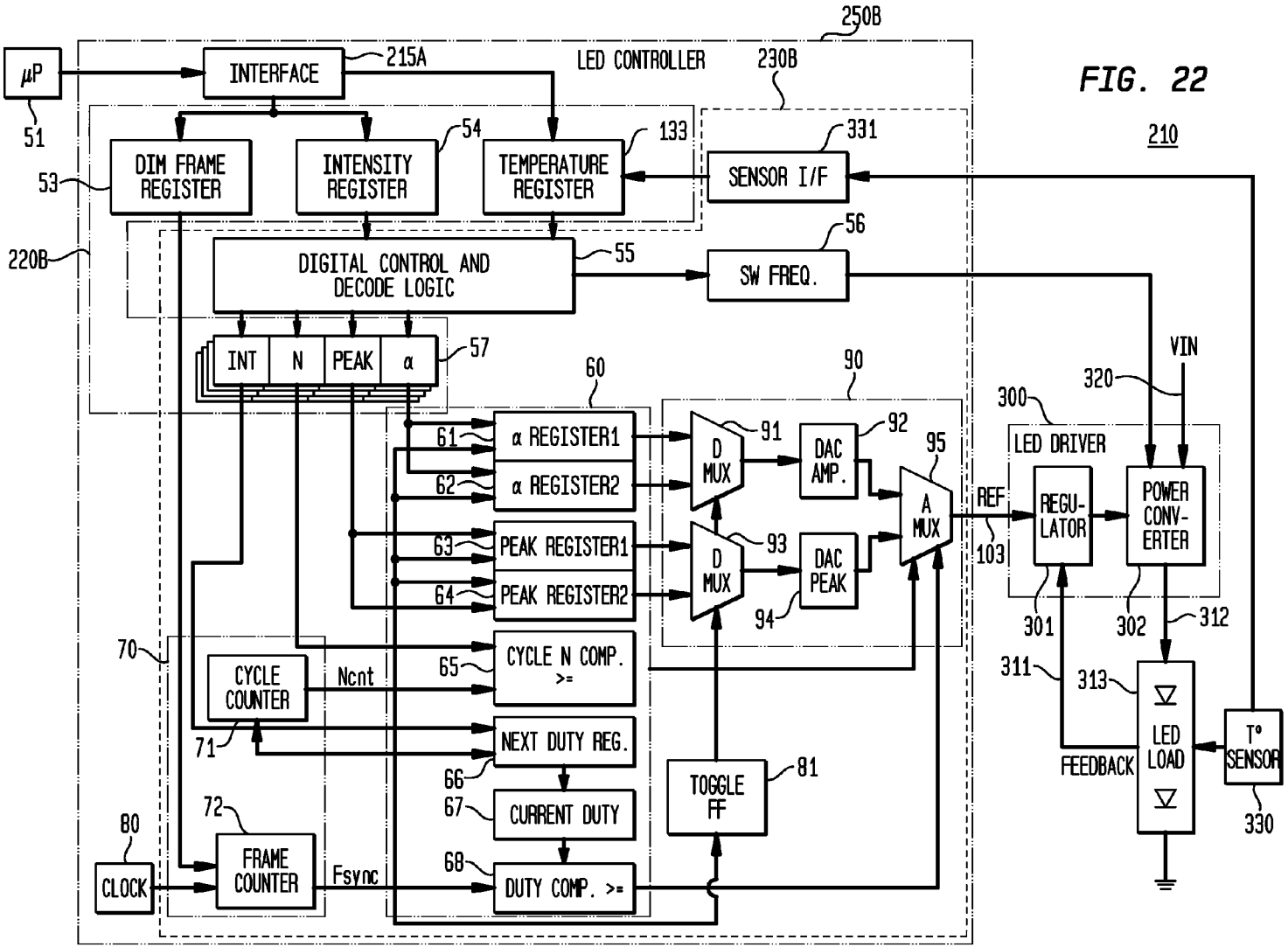
FIG. 22
210
LED CONTROLLER
250B
230B
220B
μP
51
INTERFACE
215A
DIM FRAME REGISTER
53
INTENSITY REGISTER
54
TEMPERATURE REGISTER
133
SENSOR I/F
331
DIGITAL CONTROL AND DECODE LOGIC
55
SW FREQ.
56
INT
N
PEAK
α
57
α REGISTER1
α REGISTER2
PEAK REGISTER1
PEAK REGISTER2
CYCLE N COMP. >=
NEXT DUTY REG.
CURRENT DUTY
DUTY COMP. >=
60
61
62
63
64
65
66
67
68
CYCLE COUNTER
71
FRAME COUNTER
72
70
Ncnt
Fsync
CLOCK
80
DAC AMP.
92
DAC PEAK
94
D MUX
91
D MUX
93
A MUX
95
90
TOGGLE FF
81
REF
103
LED DRIVER
300
REGU-LATOR
301
POWER CONV-ERTER
302
VIN
320
LED LOAD
313
FEEDBACK
311
312
T° SENSOR
330

REGULATION OF WAVELENGTH SHIFT AND PERCEIVED COLOR OF SOLID STATE LIGHTING WITH INTENSITY VARIATION

CROSS-REFERENCE TO A RELATED APPLICATION

This application is a continuation-in-part of Ser. No. 11/859,860, now U.S. Pat. No. 7,880,400, filed Sep. 21, 2007, inventors Dongsheng Zhou et al., entitled "Digital Driver Apparatus, Method and System for Solid State Lighting," which is commonly assigned herewith, the contents of which are incorporated herein by reference, and with priority claimed for all commonly disclosed subject matter (the "related application").

BACKGROUND

Arrays of light emitting diodes ("LEDs") are utilized for a wide variety of applications, including for general lighting and multicolored lighting. Because emitted light intensity is proportional to the average current through an LED (or through a plurality of LEDs connected in series), adjusting the average current through the LED(s) is one typical method of regulating the intensity or the color of the illumination source.

Because a light-emitting diode is a semiconductor device that emits incoherent, narrow-spectrum light when electrically biased in the forward direction of its (p-n) junction, the most common methods of changing the output intensity of an LED biases its p-n junction by varying either the forward current ("I") or forward bias voltage ("V"), according to the selected LED specifications, which may be a function of the selected LED fabrication technology. For driving an illumination system (e.g., an array of LEDs), electronic circuits typically employ a converter to transform an AC input voltage (e.g., AC line voltage, also referred to as "AC mains") and provide a DC voltage source, with a linear "regulator" then used to regulate the lighting source current. Such converters and regulators are often implemented as a single unit, and may be referred to equivalently as either a converter or a regulator.

Pulse width modulation ("PWM"), in which a pulse is generated with a constant amplitude but having a duty cycle which may be variable, is a technique for regulating average current and thereby adjusting the emitted light intensity (also referred to as "dimming") of LEDs, other solid-state lighting, LCDs, and fluorescent lighting, for example. See, e.g., Application Note AN65 "A fourth generation of LCD backlighting technology" by Jim Williams, Linear Technology, November 1995 (LCDs); Vitello U.S. Pat. No. 5,719,474 (dimming of fluorescent lamps by modulating the pulse width of current pulses); and Ihor Lys et al., U.S. Pat. Nos. 6,340,868 and 6,211,626, entitled "Illumination components" (pulse width modulated current control or other form of current control for intensity and color control of LEDs). In these applications for LEDs, a processor is typically used for controlling the amount of electrical current supplied to each LED, such that a particular amount of current supplied to the LED module generates a corresponding color within the electromagnetic spectrum.

Such current control for dimming may be based on a variety of modulation techniques, such as PWM current control, analog current control, digital current control and any other current control method or system for controlling the current. For example, in Mueler et al., U.S. Pat. Nos. 6,016,038, 6,150,774, 6,788,011, 6,806,659, and 7,161,311, entitled "Multicolored LED Lighting Method and Apparatus", under the control of a processor (or other controller), the brightness and/or color of the generated light from LEDs is altered using pulse-width modulated signals, at high or low voltage levels, with a preprogrammed maximum current allowed through the LEDs, in which an activation signal is used for a period of time corresponding to the duty cycle of a PWM signal (with the timing signal effectively being the PWM period). See also U.S. Pat. Nos. 6,528,934, 6,636,003, 6,801,003, 6,975,079, 7,135,824, 7,014,336, 7,038,398, 7,038,399 (a processor may control the intensity or the color by providing a regulated current using a pulse modulated signal, pulse width modulated signals, pulse amplitude modulated signals, analog control signals and other control signals to vary the output of LEDs, so that a particular amount of current supplied generates light of a corresponding color and intensity in response to a duty cycle of PWM), and 6,963,175 (pulse amplitude modulated (PAM) control).

These methods of controlling time averaged forward current of LEDs using different types of pulse modulations, at constant or variable frequency, by switching the LED current alternatively from a predetermined maximum value toward a lower value (including zero), creates electromagnetic interference ("EMI") problems and also suffers from a limitation on the depth of intensity variation. Analog control/Constant Current Reduction (or Regulation) ("CCR"), which typically varies the amplitude of the supplied current, also has various problems, including inaccurate control of intensity, especially at low current levels (at which component tolerances are most sensitive), and including instability of LED performance at low energy biasing of the p-n junction, leading to substantial wavelength shifting and corresponding color distortions.

As described in greater detail below with reference to FIGS. 1-3, both the PWM and CCR techniques of adjusting brightness also result in shifting the wavelength of the light emitted, further resulting in color distortions which may be unacceptable for many applications. Various methods of addressing such color distortions, which are perceptible to the human eye and which can interfere with desired lighting applications, have not been particularly successful. For example, in McKinney et al. U.S. Pat. No. 7,088,059 analog control is used over a first range of intensities, while PWM or pulse frequency modulation ("PFM") control and analog control is used over a second range of illumination intensities. In Mick U.S. Pat. No. 6,987,787, PWM control is used in addition to variable current control, to provide a much wider range of brightness control by performing a "multiplying" function to the two control inputs (peak current control and PWM control). Despite some improvement of intensity control and color mixing of these two patents, however, the proposed combinations of averaging techniques still do not address the resulting wavelength shifting and corresponding perceived color changes when these techniques are executed, either as a single analog control or as a combination of pulse and analog controls.

Depending on a quality of the light source, this wavelength change may be tolerated, assuming the reduced quality of the light is acceptable. It has been proposed to correct this distortion through substantially increasing the complexity and cost of the control system by adding emission (color) sensors and other devices to attempt to compensate for the emission shift during intensity regulation. See Application Brief AB 27 "For LCD backlighting Luxeon DCC" Lumiledes, January 2005, at FIG. 5.1 (Functional model of Luxeon DCC driver).

Accordingly, a need remains for an apparatus, system, and method for controlling the intensity (brightness) of light emissions for solid state devices such as LEDs, while simultaneously providing for substantial stability of perceived color emission and control over wavelength shifting, over both a range of intensities and also over a range of LED junction temperatures. Such an apparatus, system, and method should be capable of being implemented with few components, and without requiring extensive feedback systems.

SUMMARY

The representative embodiments of the present disclosure provide numerous advantages for controlling the intensity of light emissions for solid state devices such as LEDs, while simultaneously providing for substantial stability of perceived color emission, over both a range of intensities and also over a range of LED junction temperatures. The representative embodiments provide digital control, without including external compensation. The representative embodiments do not utilize significant resistive impedances in the current path to the LEDs, resulting in appreciably lower power losses and increased efficiency. The representative current regulator embodiments also utilize comparatively fewer components, providing reduced cost and size, while simultaneously increasing efficiency and enabling longer battery life when used in portable devices, for example.

A representative embodiment provides a method of controlling an intensity of light emitted from a solid state lighting system, the solid state lighting having a first emitted spectrum at full intensity, with a first electrical biasing for the solid state lighting producing a first wavelength shift, and with a second electrical biasing for the solid state lighting producing a second, opposing wavelength shift. The first and second wavelength shifts are typically determined as corresponding first and second peak wavelengths of the emitted spectrum. The representative method comprises: receiving information designating a selected intensity level lower than full intensity; and providing a combined first electrical biasing and second electrical biasing to the solid state lighting to generate emitted light having the selected intensity level and having a second emitted spectrum within a predetermined variance of the first emitted spectrum. The predetermined variance may be substantially zero or within a selected tolerance level. The first electrical biasing and the second electrical biasing may be a forward current or an LED bias voltage.

It should be noted that as used herein, the terms "spectrum" and "spectra" should be interpreted broadly to mean and include a single wavelength to a range of wavelengths of any emitted light. For example, depending upon any number of factors including dispersion, a typical green LED may emit light primarily at a single wavelength (e.g., 526 nm), a small range of wavelengths (e.g., 525.8-526.2 nm), or a larger range of wavelengths (e.g., 522-535 nm). Accordingly, as indicated above, the wavelength shifts referred to herein should be measured as peak wavelengths of the emitted spectrum, and such an emitted spectrum may range from a quite narrow band (e.g., a single wavelength) to a considerably broader band (a range of wavelengths), depending upon the type of solid state lighting and various other conditions. In addition, various mixes and combinations of wavelengths are also included, such as combinations of red, green, and blue wavelengths, for example, each of which generally has a corresponding peak wavelength, and each of which may have the various narrower or broader ranges of wavelengths described above. Further, the various wavelength shifts of emitted spectra may refer to a shift in a peak wavelength, corresponding shifts of multiple peak wavelengths, or an overall or composite shift of multiple wavelengths, as the context may suggest. For example, in accordance with the present disclosure, wavelength shifts of a plurality of dominant peak wavelengths for a corresponding plurality of colors (e.g., red, green and blue) are controlled within corresponding predetermined variances, in response to variables such as intensity, temperature, selected color temperature (intensity and wavelength/spectra), selected lighting effects, other criteria, etc.

It should also be noted that the various references to a "combination" of electrical biasing techniques should also be interpreted broadly to include any type or form of combining, as discussed in greater detail below, such as an additive superposition of a first biasing technique with a second (or third or more) biasing technique; a piece-wise superposition of a first biasing technique with a second (or third or more) biasing technique (i.e., a time interval-based superposition, with a first biasing technique applied in a first time interval followed by a second (or third or more) biasing technique applied in a second (or third or more) time interval); an alternating of a first biasing technique with a second (or third or more) biasing technique; or any other pattern comprised of or which can be decomposed into at least two or more different biasing techniques during a selected time interval. It should also be noted that providing such a combination of two or more electrical biasing techniques will result in an applied electrical biasing which has its own corresponding waveform which will differ from the waveforms of the first and second biasing techniques. For example, a combined or composite waveform may be created by applying a first biasing technique in a first time interval, followed by a second biasing technique in a second time interval, followed by a third biasing technique in a third time interval, followed by repeating this sequence of first, second and third biasing techniques for the next corresponding first, second and third time intervals (periods). The resulting waveform of such a combination may be referred to equivalently as a piece-wise or time-based superposition of the first, second and third biasing techniques. The combination may be represented in any number of equivalent ways, for example, as one or more parameters, as one or more control signals, or as a resulting electrical biasing waveform. For example, two or more biasing techniques may be selected, having first and second respective waveforms, with the resulting combination utilized to create or provide parameters (such as operational parameters) and/or control signals which then operate in a lighting system to produce a third waveform (as an instance of the resulting combination) for the electrical biasing provided to the solid state lighting. Any and all of these different representations or instantiations may be considered a resulting combination or composite waveform in accordance with the present disclosure.

Reference to a parameter or parameters is also to be construed broadly, and may mean and include coefficients, variables, operational parameters, a value stored in a memory, or any other value or number which can be utilized to represent a signal, such as a time-varying signal. For example, one or more parameters may be derived and stored in a memory and utilized by a controller to generate a control signal, mentioned above, for a lighting system which provides an electrical biasing having a third, combined waveform. Continuing with the example, in this instance the parameters may be stored in memory and may represent information such as duty cycle, amplitude, time period or time interval, frequency, duration, repetition interval or repetition period, other time- or interval-defined values, and so on, as discussed in greater detail below. For example, time-defined values of amplitude and duration are representative parameters, such as 100 mV from the interval of 0 to 1 microseconds, followed by 200 mV from the interval of 1 to 2 microseconds, followed by 0 mV from the interval of 2 to 3 microseconds, which sequence may then be repeated using a 3 microsecond repetition period, for example, beginning with 100 mV from the interval of 3 to 4 microseconds, etc.

In a first representative embodiment, the combined first electrical biasing and second electrical biasing is a superposition of the first electrical biasing and the second electrical biasing. The superposition of the first electrical biasing and the second electrical biasing may be at least one predetermined parameter to produce the second emitted spectrum within the predetermined variance for a selected intensity level of a plurality of intensity levels. The combined first electrical biasing and second electrical biasing may comprise a superposition of a symmetric or asymmetric AC signal on a DC signal having an average component. The combined first electrical biasing and second electrical biasing may have a duty cycle and an average current level, and the duty cycle and the average current level may be parameters stored in a memory and correspond to a selected intensity level of a plurality of intensity levels.

In another representative embodiment, the combined first electrical biasing and second electrical biasing may be a superposition of or an alternation between at least two of the following types of electrical biasing: pulse width modulation, constant current regulation, pulse frequency modulation; and pulse amplitude modulation.

In various representative embodiments, wherein the combined first electrical biasing and second electrical biasing has a first duty cycle ratio of peak electrical biasing, a second duty cycle ratio of no forward biasing, and an average current level, which are related to a selected intensity level according to a first relation of $$d = \frac{k_2}{1 + k_2} D$$

and a second relation of $$\alpha = \frac{d}{k_2(1 - d - \beta)},$$

in which variable "d" is the first duty cycle ratio, variable "α" is an amplitude modulation ratio corresponding to the first average current level, variable "D" is a dimming ratio corresponding to the selected intensity level, variable "β" is the second duty cycle ratio, coefficient "$k_1$" is a linear coefficient less than one, and coefficient "$k_2$" is a ratio of averaged biasing voltage or current for wavelength compensation.

In another representative embodiment, the combined first electrical biasing and second electrical biasing is an alternation between the first electrical biasing and second electrical biasing. For example, the first electrical biasing may be pulse width modulation having a first duty cycle lower than a full intensity duty cycle and the second electrical biasing may be constant current regulation having a first average current level lower than a full intensity current level. The first electrical biasing may be provided for a first modulation period and the second electrical biasing may be provided for a second modulation period, which may be corresponding numbers of clock cycles. In representative embodiments, the first duty cycle, the first average current level, the first modulation period, and the second modulation period are predetermined parameters to produce the second emitted spectrum within the predetermined variance for a selected intensity level of a plurality of intensity levels.

Generally, the combined first electrical biasing and second electrical biasing may be characterized as an asymmetric or symmetric AC signal with a positive average current level. For example, a combined first electrical biasing and second electrical biasing may be pulse width modulation with a peak current in a high state and an average current level at a low state.

In another representative embodiment, the solid state lighting comprises at least one light emitting diode ("LED"), and the alternating first electrical biasing and second electrical biasing are provided during at least one of the following: within a single dimming cycle of a switch mode LED driver, alternately every dimming cycle of the switch mode LED driver, alternately every second dimming cycle of the switch mode LED driver, alternately every third dimming cycle of the switch mode LED driver, alternately an equal number of consecutive dimming cycle of the switch mode LED driver, or alternately an unequal number of consecutive dimming cycle of the switch mode LED driver.

In various representative embodiments, the combined first electrical biasing and second electrical biasing is predetermined from a statistical characterization of the solid state lighting in response to the first electrical biasing and the second electrical biasing at a plurality of intensity levels and/or in response to a plurality of temperature levels. In another representative embodiment, the combined first electrical biasing and second electrical biasing is determined in real time from at least one linear equation to produce the second emitted spectrum within the predetermined variance for a selected intensity level.

The representative method may also provide for synchronizing the combined first electrical biasing and second electrical biasing with a switching cycle of a switch mode LED driver. For representative embodiments, the combined first electrical biasing and second electrical biasing has a duty cycle and an average current level which are related to a selected intensity level according to a first relation of $$d = \sqrt{\frac{D}{k}}$$

and a second relation of $\alpha = \sqrt{Dk}$, in which variable "d" is the duty cycle, variable "α" is an analog ratio corresponding to the average current level, variable "D" is a dimming ratio corresponding to the selected intensity level, and coefficient "k" is determined to balance the first and second wavelength shifts within the predetermined variance.

The representative method may also provide for modifying the combined first electrical biasing and second electrical biasing in response to a sensed or determined junction temperature of the light emitting diode. In various representative embodiments, the providing of the combined first electrical biasing and second electrical biasing may further comprise: processing a plurality of operational parameters into corresponding electrical biasing control signals; providing the corresponding electrical biasing control signals to a driver circuit; and operating the driver circuit with a time averaging modulation of forward current conforming to the corresponding electrical biasing control signals to provide the selected intensity level within a dimming cycle of the driver circuit.

In other representative embodiments, the solid state lighting may comprise a plurality of arrays of light emitting diodes, wherein the step of providing a combined first electrical biasing and second electrical biasing to the solid state lighting further comprises separately providing a corresponding combined first electrical biasing and second electrical biasing to each array of the plurality of arrays of light emitting diodes to generate an overall second emitted spectrum within the predetermined variance of the first emitted spectrum. In addition, each combined first electrical biasing and second electrical biasing may correspond to a type of light emitting diode comprising the corresponding array of the plurality of arrays of light emitting diodes. In various representative embodiments, at least three arrays of the plurality of arrays of light emitting diodes have corresponding emission spectra of different colors.

Other representative embodiments provide for modifying a temperature of a selected array of the plurality of arrays of light emitting diodes to maintain the overall second emitted spectrum within the predetermined variance of the first emitted spectrum. In addition, the methodology may include predicting a spectral response of the solid state lighting in response to the combined first electrical biasing and second electrical biasing at the selected intensity level.

Another representative embodiment provides an apparatus for adjusting an intensity of light emitted from a solid state lighting system, with the apparatus couplable to the solid state lighting having a first emitted spectrum at full intensity, with a first electrical biasing for the solid state lighting producing a first wavelength shift, and with a second electrical biasing for the solid state lighting producing a second, opposing wavelength shift. The representative apparatus comprises: an interface adapted to receive information designating a selected intensity level lower than full intensity; a memory adapted to store a plurality of parameters corresponding to a plurality of intensity levels, at least one parameter of the plurality of parameters corresponding to the selected intensity level; and a controller coupled to the memory, the controller adapted to retrieve from the memory the at least one parameter and to convert the at least one parameter into a corresponding control signal to provide a combined first electrical biasing and second electrical biasing to the solid state lighting to generate emitted light having the selected intensity level and having a second emitted spectrum within a predetermined variance of the first emitted spectrum.

In a first representative embodiment, the control signal provides the combined first electrical biasing and second electrical biasing as a superposition of the first electrical biasing and the second electrical biasing. In another representative embodiment, the control signal provides the combined first electrical biasing and second electrical biasing as an alternation of the first electrical biasing and the second electrical biasing. The plurality of parameters may be predetermined from a statistical characterization of the solid state lighting in response to the first electrical biasing and the second electrical biasing at a plurality of intensity levels and/or in response to a plurality of temperature levels. Alternatively, the plurality of parameters may comprise at least one linear equation, and the controller may be further adapted to generate the control signal in real time from the at least one linear equation to provide the combined first electrical biasing and second electrical biasing to produce the second emitted spectrum within the predetermined variance for the selected intensity level. The controller also may be further adapted to synchronize the control signal with a switching cycle of a switch mode LED driver.

Representative embodiments may also include a temperature sensor and the controller may be further adapted to modify the control signal in response to a sensed or determined junction temperature of the light emitting diode.

In embodiments wherein the solid state lighting comprises a plurality of arrays of light emitting diodes, the controller may be further adapted to generate separate, corresponding control signals to provide a corresponding combined first electrical biasing and second electrical biasing to each array of the plurality of arrays of light emitting diodes to generate an overall second emitted spectrum within the predetermined variance of the first emitted spectrum. Each combined first electrical biasing and second electrical biasing may correspond to a type of light emitting diode comprising the corresponding array of the plurality of arrays of light emitting diodes. The controller also may be further adapted to generate a second control signal to modify a temperature of a selected array of the plurality of arrays of light emitting diodes to maintain the overall second emitted spectrum within the predetermined variance of the first emitted spectrum.

In other representative embodiments wherein the solid state lighting comprises a plurality of arrays of light emitting diodes coupled to a corresponding plurality of driver circuits, the representative apparatus may further comprise a plurality of controllers, with each controller of the plurality of controllers couplable to a corresponding driver circuit, and each controller further adapted to generate separate, corresponding control signal to the corresponding driver circuit to provide a corresponding combined first electrical biasing and second electrical biasing to the corresponding array of the plurality of arrays of light emitting diodes to generate an overall second emitted spectrum within the predetermined variance of the first emitted spectrum.

Another representative embodiment provides a solid state lighting system, comprising: a plurality of arrays of light emitting diodes having a first emitted spectrum at full intensity, a first electrical biasing for at least one array of the plurality of arrays producing a first wavelength shift, a second electrical biasing for the at least one array of the plurality of arrays producing a second, opposing wavelength shift; a plurality of driver circuits, each driver circuit coupled to a corresponding array of the plurality of arrays of light emitting diodes; an interface adapted to receive information designating a selected intensity level lower than full intensity; a memory adapted to store a plurality of parameters corresponding to a plurality of intensity levels, at least one parameter of the plurality of parameters corresponding to the selected intensity levels; and at least one controller coupled to the memory and to a first driver circuit of the plurality of driver circuits, the controller adapted to retrieve from the memory the at least one parameter and to convert the at least one parameter into a corresponding control signal to the first driver circuit to provide a combined first electrical biasing and second electrical biasing to the corresponding array to generate emitted light having the selected intensity level and having a second emitted spectrum within a predetermined variance of the first emitted spectrum.

In this representative embodiment, the second emitted spectrum may be a single or overall color generated within the predetermined variance, a single or overall color temperature generated within the predetermined variance, a sequence of a single color emitted at a given time, a flicker-reduced or flicker-eliminated emitted spectrum, or a dynamic lighting effect as requested by a second signal received by the interface.

The representative system may also include a temperature sensor and the at least one controller may be further adapted to modify the corresponding control signal in response to a sensed or determined junction temperature of at least one array of the plurality of arrays of light emitting diodes, or to generate a second control signal to modify a temperature of a selected array of the plurality of arrays of light emitting diodes to maintain the overall second emitted spectrum within the predetermined variance of the first emitted spectrum.

In other representative embodiments, the system further comprises a plurality of controllers, with each controller of the plurality of controllers coupled to a corresponding driver circuit, and each controller further adapted to generate separate, corresponding control signal to the corresponding driver circuit to provide a corresponding combined first electrical biasing and second electrical biasing to the corresponding array of the plurality of arrays of light emitting diodes to generate an overall second emitted spectrum within the predetermined variance of the first emitted spectrum.

The representative system embodiment may also include a cooling element coupled to at least one array of the plurality of arrays of light emitting diodes and the controller may be further adapted to generate a second control signal to the cooling element to lower a temperature of the at least one array to maintain the overall second emitted spectrum within the predetermined variance of the first emitted spectrum.

Another representative embodiment provides an apparatus for controlling an intensity of light emitted from an array of light emitting diodes, with the apparatus couplable to the array having a first emitted spectrum at full intensity and at a selected temperature, with a first electrical biasing for the array producing a first wavelength shift, and with a second electrical biasing for the array producing a second, opposing wavelength shift. The representative apparatus comprises: an interface adapted to receive information designating a selected intensity level lower than full intensity; a memory adapted to store a plurality of parameters corresponding to a plurality of intensity levels and a plurality of temperatures, at least one parameter of the plurality of parameters corresponding to the selected intensity level and a sensed or determined temperature; and a controller coupled to the memory, the controller adapted to retrieve from the memory the at least one parameter and to convert the at least one parameter into a corresponding control signal to provide a combined first electrical biasing and second electrical biasing to the array to generate emitted light having the selected intensity level and having a second emitted spectrum within a predetermined variance of the first emitted spectrum.

Another representative method of controlling an emitted spectrum from a solid state lighting system is also disclosed, with the solid state lighting having a first emitted spectrum at a selected intensity and at a selected temperature, with a first electrical biasing for the solid state lighting producing a first wavelength shift, and with a second electrical biasing for the solid state lighting producing a second, opposing wavelength shift. The representative method comprises: determining a temperature associated with the solid state lighting; and providing a combined first electrical biasing and second electrical biasing to the solid state lighting to generate emitted light having a second emitted spectrum over a predetermined range of temperatures and within a predetermined variance of the first emitted spectrum.

As discussed above, the combined first electrical biasing and second electrical biasing may be a superposition of the first electrical biasing and the second electrical biasing, and the superposition may be at least one predetermined parameter to produce the second emitted spectrum within the predetermined variance for the selected intensity level and predetermined range of temperatures. The combined first electrical biasing and second electrical biasing also may have a duty cycle and an average current level, and wherein the duty cycle and the average current level are parameters stored in a memory and correspond to the predetermined range of temperatures.

The representative method may also include cooling the solid state lighting or reducing the intensity of the light emitted from the solid state lighting to maintain the second emitted spectrum within the predetermined variance. The determination of the temperature associated with the solid state lighting may further comprise sensing a junction temperature associated with the solid state lighting, or sensing a temperature of a device associated with the solid state lighting, such as a heat sink or an enclosure for the solid state lighting.

The combined first electrical biasing and second electrical biasing may be predetermined from a statistical characterization of the solid state lighting in response to a plurality of temperature levels, and further, in response to the first electrical biasing and the second electrical biasing at a plurality of intensity levels. The combined first electrical biasing and second electrical biasing may be determined in real time from at least one linear equation to produce the second emitted spectrum within the predetermined variance for the predetermined range of temperatures.

The representative method embodiment may also include modifying the combined first electrical biasing and second electrical biasing in response to the selected intensity level, and receiving an input signal selecting the intensity level.

When the solid state lighting comprises a plurality of arrays of light emitting diodes, the step of providing a combined first electrical biasing and second electrical biasing to the solid state lighting may further comprise separately providing a corresponding combined first electrical biasing and second electrical biasing to each array of the plurality of arrays of light emitting diodes to generate an overall second emitted spectrum over the predetermined range of temperatures and within the predetermined variance of the first emitted spectrum. The representative method embodiment may also include modifying a temperature of a selected array of the plurality of arrays of light emitting diodes to maintain the overall second emitted spectrum within the predetermined variance of the first emitted spectrum.

The representative methodology may also include predicting a spectral response of the solid state lighting in response to the combined first electrical biasing and second electrical biasing over the predetermined range of temperatures.

Another representative apparatus is disclosed for controlling an emitted spectrum from a solid state lighting system, the apparatus couplable to the solid state lighting, with the solid state lighting having a first emitted spectrum at a selected intensity and at a selected temperature, with a first electrical biasing for the solid state lighting producing a first wavelength shift, and with a second electrical biasing for the solid state lighting producing a second, opposing wavelength shift. The representative apparatus comprises: a memory adapted to store a plurality of parameters corresponding to a predetermined range of temperatures; and a controller coupled to the memory, the controller adapted to determine a temperature associated with the solid state lighting, to retrieve from the memory at least one parameter of the plurality of parameters corresponding to the determined temperature, and to convert the at least one parameter into a corresponding control signal to provide a combined first electrical biasing and second electrical biasing to the solid state lighting to generate emitted light having a second emitted spectrum over the predetermined range of temperatures and within a predetermined variance of the first emitted spectrum.

In this representative embodiment, the controller may be further adapted to generate a second control signal to a cooling element coupled to the solid state lighting to cool the solid state lighting to maintain the second emitted spectrum within the predetermined variance, or to generate a second control signal to reduce the intensity of the light emitted from the solid state lighting to maintain the second emitted spectrum within the predetermined variance. The controller may be further adapted to determine the temperature associated with the solid state lighting in response to a temperature signal received from a junction temperature sensor associated with the solid state lighting, or in response to a temperature signal received from a device temperature sensor associated with the solid state lighting, such as when the device is a heat sink or an enclosure for the solid state lighting.

When the solid state lighting comprises a plurality of arrays of light emitting diodes, the controller may be further adapted to generate separate, corresponding control signals to provide a corresponding combined first electrical biasing and second electrical biasing to each array of the plurality of arrays of light emitting diodes to generate an overall second emitted spectrum within the predetermined variance of the first emitted spectrum and over the predetermined range of temperatures. The controller may be further adapted to generate a second control signal to modify a temperature of a selected array of the plurality of arrays of light emitting diodes to maintain the overall second emitted spectrum within the predetermined variance of the first emitted spectrum and over the predetermined range of temperatures.

When the solid state lighting comprises a plurality of arrays of light emitting diodes coupled to a corresponding plurality of driver circuits, the representative apparatus may further comprise a plurality of controllers, each controller of the plurality of controllers couplable to a corresponding driver circuit, and each controller further adapted to generate a separate, corresponding control signal to the corresponding driver circuit to provide a corresponding combined first electrical biasing and second electrical biasing to the corresponding array of the plurality of arrays of light emitting diodes to generate an overall second emitted spectrum within the predetermined variance of the first emitted spectrum over the predetermined range of temperatures.

A representative solid state lighting system is also disclosed, which comprises: a plurality of arrays of light emitting diodes having a first emitted spectrum at a selected intensity, a first electrical biasing for at least one array of the plurality of arrays producing a first wavelength shift, a second electrical biasing for the at least one array of the plurality of arrays producing a second, opposing wavelength shift; a temperature sensor coupled to at least one array of the plurality of arrays of light emitting diodes; a plurality of driver circuits, each driver circuit coupled to a corresponding array of the plurality of arrays of light emitting diodes; an interface adapted to receive information designating the selected intensity; a memory adapted to store a plurality of parameters corresponding to a predetermined range of temperatures; and at least one controller coupled to the memory and to a first driver circuit of the plurality of driver circuits, the controller adapted to receive a temperature signal associated with the solid state lighting, to retrieve from the memory at least one parameter of the plurality of parameters corresponding to the temperature signal, and to convert the at least one parameter into a corresponding control signal to the first driver circuit to provide a combined first electrical biasing and second electrical biasing to the solid state lighting to generate emitted light having a second emitted spectrum over the predetermined range of temperatures and within a predetermined variance of the first emitted spectrum.

A cooling element may be coupled to a selected array of the plurality of arrays of light emitting diodes and the at least one controller is further adapted to generate a second control signal to the cooling element to lower a temperature of the at least one array to maintain the overall second emitted spectrum within the predetermined variance of the first emitted spectrum, or generate a second control signal to reduce the intensity of the light emitted from at least one array of the plurality of arrays of light emitting diodes to maintain the second emitted spectrum within the predetermined variance.

The representative system may also include a plurality of controllers, with each controller of the plurality of controllers coupled to a corresponding driver circuit, and each controller further adapted to generate a separate, corresponding control signal to the corresponding driver circuit to provide a corresponding combined first electrical biasing and second electrical biasing to the corresponding array of the plurality of arrays of light emitting diodes to generate an overall second emitted spectrum within the predetermined variance of the first emitted spectrum.

A representative apparatus is also disclosed for controlling an emitted spectrum from an array of light emitting diodes, the apparatus couplable to the array having a first emitted spectrum at a selected intensity and at a selected temperature, with a first electrical biasing for the array producing a first wavelength shift, and with a second electrical biasing for the array producing a second, opposing wavelength shift. The representative apparatus comprises: an interface adapted to receive information designating the selected intensity level lower than full intensity; a memory adapted to store a plurality of parameters corresponding to a plurality of intensity levels and a plurality of temperatures, at least one parameter of the plurality of parameters corresponding to the selected intensity level and a sensed or determined temperature; and a controller coupled to the memory, the controller adapted to retrieve from the memory the at least one parameter and to convert the at least one parameter into a corresponding control signal to provide a combined first electrical biasing and second electrical biasing to the array to generate emitted light having the selected intensity level and having a second emitted spectrum within a predetermined variance of the first emitted spectrum over a predetermined range of temperatures.

Another representative method for varying an intensity of light emitted from at least one or more substantially similar light emitting diodes is also disclosed, with a first electrical biasing for the at least one or more substantially similar light emitting diodes producing a first wavelength shift, and with a second electrical biasing for the at least one or more substantially similar light emitting diodes producing a second, opposing wavelength shift. The representative method comprises: monitoring an input control signal, the input control signal designating a selected intensity level; retrieving a plurality of parameters stored in a memory, the plurality of parameters designating a corresponding combination of the first electrical biasing and the second electrical biasing for the selected intensity level; processing the plurality of parameters into at least one input electrical biasing control signal; and operating the at least one or more substantially similar light emitting diodes with a time-averaged modulation of forward current conforming to the at least one input electrical biasing control signal to provide the selected intensity level within a dimming cycle.

A representative lighting system having variable intensity is also disclosed, with the representative system comprising:

at least one or more substantially similar light emitting diodes connected in a channel, a first electrical biasing for the at least one or more substantially similar light emitting diodes producing a first wavelength shift, and a second electrical biasing for the at least one or more substantially similar light emitting diodes producing a second, opposing wavelength shift; at least one driver circuit coupled to the at least one or more substantially similar light emitting diodes, the at least one driver circuit comprising a regulator and a power converter, the driver circuit adapted to respond to a plurality of input operational signals to provide a selected combination of the first electrical biasing and the second electrical biasing to the at least one or more substantially similar light emitting diodes; and at least one controller couplable to a user interface and coupled to the at least one driver circuit, the at least one controller further comprising a memory, the at least one controller adapted to retrieve a plurality of parameters stored in a memory, the plurality of parameters corresponding to a selected intensity level provided by the user interface and designating the selected combination of the first electrical biasing and the second electrical biasing; the at least one controller further adapted to convert the plurality of parameters into at least one input operational control signal to provide the selected intensity level with wavelength emission control.

A representative illumination control method is also provided for at least one or more substantially similar light emitting diodes providing emitted light, with a first electrical biasing for the at least one or more substantially similar light emitting diodes producing a first wavelength shift, and with a second electrical biasing for the at least one or more substantially similar light emitting diodes producing a second, opposing wavelength shift. The representative method comprises: monitoring an input control signal, the input control signal designating a selected lighting effect; retrieving a plurality of parameters stored in a memory, the plurality of parameters designating a corresponding combination of the first electrical biasing and the second electrical biasing for the selected lighting effect; processing the plurality of parameters into at least one input electrical biasing control signal; and operating the at least one or more substantially similar light emitting diodes with a time-averaged modulation of forward current conforming to the at least one input electrical biasing control signal to provide the selected lighting effect within a dimming cycle.

Another representative method of controlling an intensity of light emitted from at least one or more substantially similar light emitting diodes with compensation for spectral changes due to temperature variation is also disclosed, with the at least one or more substantially similar light emitting diodes having a first emitted spectrum at full intensity, with a first electrical biasing for the at least one or more substantially similar light emitting diodes producing a first wavelength shift, and with a second electrical biasing for the at least one or more substantially similar light emitting diodes producing a second, opposing wavelength shift. The representative method comprises: monitoring an input control signal, the input control signal designating a selected intensity level; determining a temperature associated with the at least one or more substantially similar light emitting diodes; retrieving a plurality of parameters stored in a memory, the plurality of parameters designating a corresponding combination of the first electrical biasing and the second electrical biasing for the selected intensity level and the determined temperature; processing the plurality of parameters into at least one input electrical biasing control signal; and operating the at least one or more substantially similar light emitting diodes with a time-averaged modulation of forward current conforming to the at least one input electrical biasing control signal to provide the selected intensity level over a predetermined range of temperatures and having a second emitted spectrum within a predetermined variance of the first emitted spectrum.

Another representative illumination control method for a plurality of light emitting diodes is also disclosed, with the plurality of light emitting diodes comprising at least one or more first light emitting diodes having a first spectrum and at least one or more second light emitting diodes having a second, different spectrum, with a first electrical biasing for the at least one or more first light emitting diodes producing a first wavelength shift, with a second electrical biasing for the at least one or more first light emitting diodes producing a second wavelength shift opposing the first wavelength shift, with a third electrical biasing for the at least one or more second light emitting diodes producing a third wavelength shift, and with a fourth electrical biasing for the at least one or more second light emitting diodes producing a fourth wavelength shift opposing the third wavelength shift. The representative method comprises: monitoring an input control signal, the input control signal designating a first intensity level for the at least one or more first light emitting diodes and a second intensity level for the at least one or more second light emitting diodes; retrieving a first plurality of parameters stored in a memory, the plurality of parameters designating a corresponding combination of the first electrical biasing and the second electrical biasing for the first intensity level; retrieving a second plurality of parameters stored in the memory, the second plurality of parameters designating a corresponding combination of the third electrical biasing and the fourth electrical biasing for the second intensity level; processing the first plurality of parameters into at least one first input electrical biasing control signal for the at least one or more first light emitting diodes; processing the second plurality of parameters into at least one second input electrical biasing control signal for the at least one or more second light emitting diodes; operating the at least one or more first light emitting diodes with a first time-averaged modulation of forward current conforming to the at least one first input electrical biasing control signal to provide the first intensity level; and operating the at least one or more second light emitting diodes with a second time-averaged modulation of forward current conforming to the at least one second input electrical biasing control signal to provide the second intensity level independently of the first intensity level.

Another representative lighting system having variable intensity is also disclosed, comprising: a plurality of light emitting diodes, the plurality of light emitting diodes comprising at least one or more first light emitting diodes connected in a first channel and having a first spectrum and at least one or more second light emitting diodes connected in a second channel and having a second, different spectrum, a first electrical biasing for the at least one or more first light emitting diodes producing a first wavelength shift, a second electrical biasing for the at least one or more first light emitting diodes producing a second wavelength shift opposing the first wavelength shift, a third electrical biasing for the at least one or more second light emitting diodes producing a third wavelength shift, a fourth electrical biasing for the at least one or more second light emitting diodes producing a fourth wavelength shift opposing the third wavelength shift; at least one first driver circuit coupled to the at least one or more first light emitting diodes, the at least one first driver circuit comprising a first regulator and a first power converter, the at least one first driver circuit adapted to respond to a first plurality of input operational signals to provide a first combination of the first electrical biasing and the second electrical biasing to the at least one or more first light emitting diodes; at least one second driver circuit coupled to the at least one or more second light emitting diodes, the at least one second driver circuit comprising a second regulator and a second power converter, the at least one second driver circuit adapted to respond to a second plurality of input operational signals to provide a second combination of the third electrical biasing and the fourth electrical biasing to the at least one or more second light emitting diodes; at least one first controller couplable to a user interface and coupled to the at least one first driver circuit, the at least one first controller further comprising a first memory, the at least one first controller adapted to retrieve a first plurality of parameters stored in the first memory, the first plurality of parameters corresponding to a first intensity level provided by the user interface and designating the first combination of the first electrical biasing and the second electrical biasing; the at least one first controller further adapted to convert the first plurality of parameters into at least one first input operational control signal to provide the first intensity level of the at least one or more first light emitting diodes with wavelength emission control; and at least one second controller couplable to the user interface and coupled to the at least one second driver circuit, the at least one second controller further comprising a second memory, the at least one second controller adapted to retrieve a second plurality of parameters stored in the second memory, the second plurality of parameters corresponding to a second intensity level provided by the user interface and designating the second combination of the third electrical biasing and the fourth electrical biasing; the at least one second controller further adapted to convert the second plurality of parameters into at least one second input operational control signal to provide the second intensity level of the at least one or more second light emitting diodes with wavelength emission control.

A representative illumination control method is also disclosed for a plurality of light emitting diodes, with the plurality of light emitting diodes comprising at least one or more first light emitting diodes having a first spectrum and at least one or more second light emitting diodes having a second, different spectrum, with a first electrical biasing for the at least one or more first light emitting diodes producing a first wavelength shift, with a second electrical biasing for the at least one or more first light emitting diodes producing a second wavelength shift opposing the first wavelength shift, with a third electrical biasing for the at least one or more second light emitting diodes producing a third wavelength shift, and with a fourth electrical biasing for the at least one or more second light emitting diodes producing a fourth wavelength shift opposing the third wavelength shift. The representative method comprises: monitoring an input control signal, the input control signal designating a first intensity level for the at least one or more first light emitting diodes and a second intensity level for the at least one or more second light emitting diodes; determining a first temperature associated with the at least one or more first light emitting diodes; determining a second temperature associated with the at least one or more second light emitting diodes; retrieving a first plurality of parameters stored in a memory, the plurality of parameters designating a corresponding combination of the first electrical biasing and the second electrical biasing for the first temperature; retrieving a second plurality of parameters stored in the memory, the second plurality of parameters designating a corresponding combination of the third electrical biasing and the fourth electrical biasing for the second temperature; processing the first plurality of parameters into at least one first input electrical biasing control signal for the at least one or more first light emitting diodes; processing the second plurality of parameters into at least one second input electrical biasing control signal for the at least one or more second light emitting diodes; operating the at least one or more first light emitting diodes with a first time-averaged modulation of forward current conforming to the at least one first input electrical biasing control signal to provide a substantially constant first intensity level over a predetermined temperature range and having an emitted spectrum within a first predetermined variance of the first spectrum; and operating the at least one or more second light emitting diodes with a second time-averaged modulation of forward current conforming to the at least one second input electrical biasing control signal to provide a substantially constant second intensity level over the predetermined temperature range having an emitted spectrum within a second predetermined variance of the second spectrum.

Another representative illumination control method is disclosed to vary intensity of light from a plurality of light emitting diodes, with the plurality of light emitting diodes comprising at least one or more first light emitting diodes having a first spectrum and at least one or more second light emitting diodes having a second, different spectrum, with a first electrical biasing for the at least one or more first light emitting diodes producing a first wavelength shift, with a second electrical biasing for the at least one or more first light emitting diodes producing a second wavelength shift opposing the first wavelength shift, with a third electrical biasing for the at least one or more second light emitting diodes producing a third wavelength shift, and with a fourth electrical biasing for the at least one or more second light emitting diodes producing a fourth wavelength shift opposing the third wavelength shift. The representative method comprises: monitoring an input control signal, the input control signal designating a first intensity level for the at least one or more first light emitting diodes and a second intensity level for the at least one or more second light emitting diodes; determining a first temperature associated with the at least one or more first light emitting diodes; determining a second temperature associated with the at least one or more second light emitting diodes; retrieving a first plurality of parameters stored in a memory, the plurality of parameters designating a corresponding combination of the first electrical biasing and the second electrical biasing for the first intensity level and the first temperature; retrieving a second plurality of parameters stored in the memory, the second plurality of parameters designating a corresponding combination of the third electrical biasing and the fourth electrical biasing for the second intensity level and the second temperature; processing the first plurality of parameters into at least one first input electrical biasing control signal for the at least one or more first light emitting diodes; processing the second plurality of parameters into at least one second input electrical biasing control signal for the at least one or more second light emitting diodes; operating the at least one or more first light emitting diodes with a first time-averaged modulation of forward current conforming to the at least one first input electrical biasing control signal to provide the first intensity level having an emitted spectrum within a first predetermined variance of the first spectrum over a predetermined range of temperatures; and operating the at least one or more second light emitting diodes with a second time-averaged modulation of forward current conforming to the at least one second input electrical biasing control signal to provide the second intensity level having an emitted spectrum within a second predetermined variance of the second spectrum over the predetermined range of temperatures.

A representative solid state lighting system is also disclosed, comprising: a plurality of arrays of light emitting diodes, a first array of the plurality of arrays having a first emitted spectrum at full intensity, a first electrical biasing for the first array of the plurality of arrays producing a first wavelength shift, a second electrical biasing for the first array of the plurality of arrays producing a second, opposing wavelength shift; a temperature sensor coupled to the first array of the plurality of arrays of light emitting diodes; at least one driver circuit coupled to the first array of the plurality of arrays of light emitting diodes; an interface adapted to receive information designating a selected intensity level; a memory adapted to store a plurality of parameters corresponding to a plurality of intensity levels and a predetermined range of temperatures; and at least one controller coupled to the memory and to the at least one driver circuit, the controller adapted to receive a temperature signal from the temperature sensor, the controller adapted to retrieve from the memory at least one parameter of the plurality of parameters corresponding to the selected intensity level and the temperature signal, and to convert the at least one parameter into a corresponding control signal to the at least one driver circuit to provide a combined first electrical biasing and second electrical biasing to the first array to generate emitted light having the selected intensity level over the predetermined range of temperatures and having a second emitted spectrum within a predetermined variance of the first emitted spectrum.

Lastly, a representative lighting system having variable intensity is also disclosed, with the system comprising: a plurality of light emitting diodes, the plurality of light emitting diodes comprising at least one or more first light emitting diodes connected in a first channel and having a first spectrum and at least one or more second light emitting diodes connected in a second channel and having a second, different spectrum, a first electrical biasing for the at least one or more first light emitting diodes producing a first wavelength shift, a second electrical biasing for the at least one or more first light emitting diodes producing a second wavelength shift opposing the first wavelength shift, a third electrical biasing for the at least one or more second light emitting diodes producing a third wavelength shift, a fourth electrical biasing for the at least one or more second light emitting diodes producing a fourth wavelength shift opposing the third wavelength shift; a temperature sensor coupled to the at least one or more first light emitting diodes of the plurality of light emitting diodes; at least one first driver circuit coupled to the at least one or more first light emitting diodes, the at least one first driver circuit comprising a first regulator and a first power converter, the at least one first driver circuit adapted to respond to a first plurality of input operational signals to provide a first combination of the first electrical biasing and the second electrical biasing to the at least one or more first light emitting diodes; at least one second driver circuit coupled to the at least one or more second light emitting diodes, the at least one second driver circuit comprising a second regulator and a second power converter, the at least one second driver circuit adapted to respond to a second plurality of input operational signals to provide a second combination of the third electrical biasing and the fourth electrical biasing to the at least one or more second light emitting diodes; at least one first controller couplable to a user interface and coupled to the at least one first driver circuit, the at least one first controller further comprising a first memory, the at least one first controller adapted to retrieve a first plurality of parameters stored in the first memory, the first plurality of parameters corresponding to a sensed temperature and to a first intensity level provided by the user interface and further designating the first combination of the first electrical biasing and the second electrical biasing; the at least one first controller further adapted to convert the first plurality of parameters into at least one first input operational control signal to provide the first intensity level of the at least one or more first light emitting diodes with wavelength emission control over a predetermined range of temperatures; and at least one second controller couplable to the user interface and coupled to the at least one second driver circuit, the at least one second controller further comprising a second memory, the at least one second controller adapted to retrieve a second plurality of parameters stored in the second memory, the second plurality of parameters corresponding to the sensed temperature and a second intensity level provided by the user interface and further designating the second combination of the third electrical biasing and the fourth electrical biasing; the at least one second controller further adapted to convert the second plurality of parameters into at least one second input operational control signal to provide the second intensity level of the at least one or more second light emitting diodes with wavelength emission control over the predetermined range of temperatures.

Numerous other advantages and features of the present disclosure will become readily apparent from the following detailed description of the disclosure and the embodiments thereof, from the claims, and from the accompanying drawings.

BRIEF DESCRIPTION OF THE DRAWINGS

The features and advantages of the present disclosure will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which:

FIG. 1, divided into

FIG. 2, divided into

FIG. 3, divided into FIGS. 3A and 3B, are prior art graphical diagrams illustrating the peak wavelength of light emitted as a function of current level (for CCR) and duty cycle (for PWM), and as a function of junction temperature;

FIG. 4 is a graphical diagram illustrating a first representative current or voltage waveform (or biasing signal) for control of wavelength and perceived color emission in accordance with the teachings of the present disclosure;

FIG. 5 is a graphical diagram illustrating a second representative current or voltage waveform (or biasing signal) for control of wavelength and perceived color emission in accordance with the teachings of the present disclosure;

FIG. 21 is a block diagram of an representative first system embodiment in accordance with the teachings of the present disclosure;

FIG. 22 is a block diagram of a representative second system embodiment in accordance with the teachings of the present disclosure;

DETAILED DESCRIPTION

Figure 1A:
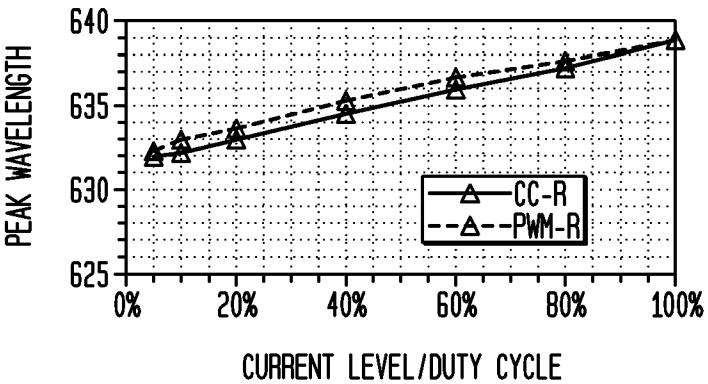
FIGS. 1A, 1B, 1C, and 1D, are prior art graphical diagrams illustrating the peak wavelength of light emitted as a function of current level (for CCR) and duty cycle (for PWM), respectively, for red, green, blue, and white LEDs.

While the present disclosure is susceptible of embodiment in many different forms, there are shown in the drawings and will be described herein in detail specific representative embodiments thereof, with the understanding that the present disclosure is to be considered as an exemplification of the principles of the disclosure and is not intended to limit the disclosure to the specific embodiments illustrated. In this respect, before explaining at least one embodiment consistent with the present disclosure in detail, it is to be understood that the disclosure is not limited in its application to the details of construction and to the arrangements of components set forth above and below, illustrated in the drawings, or as described in the examples. Methods and apparatuses consistent with the present disclosure are capable of other embodiments and of being practiced and carried out in various ways. Also, it is to be understood that the phraseology and terminology employed herein, as well as the abstract included below, are for the purposes of description and should not be regarded as limiting.

As mentioned above, the prior art using time averaged forward current control through the LEDs, e.g., PWM, PFM, PAM, Analog/CCR control, and similar techniques, has an inherent drawback of changing the wavelengths of emissions, either for intensity regulation, or in response to junction temperature drift, related to the physics of light emitting diodes. It has recently been reported in Y. Gu, N. Narendran, T. Dong, and H. Wu, "Spectral and Luminous Efficacy Change of High-power LEDs Under Different Dimming Methods," ($6^{th}$ International Conf. SSL, Proc. SPIE, 2006), that the two commonly used dimming methods, Continuous Current Reduction (CCR) and Pulse Width Modulation (PWM), change the wavelengths of the light emitted by an LED in different ways, with their experimental results illustrated in FIGS. 1-3 and described below.

In CCR dimming, the current is maintained (nearly) continuous at a given amplitude or level, at all times for a corresponding given intensity level, to achieve the dimming. For example, a full power LED my have current at one Ampere (1 A) for full brightness. Using CCR to dim the LED to approximately one-half brightness, then about one-half the constant current is sent through the LED, e.g., 0.5 A. In contrast, in PWM dimming, the peak current remains approximately fixed for all dimming/intensity values. The current through the LED is then modulated between this peak value and zero, at a sufficiently high rate to be undetectable to the human eye (or perhaps to other sensors as well), resulting in a brightness level which tends to be proportional to the approximate average value of the current through the LEDs. In the example above, it is common for the current to be modulated above 100 Hz (with suggestions of 300 Hz or more) so that the current is equal to full current (1 A) for half of the modulation period and is equal to zero the other half of the modulation period (duty ratio of 0.5), for example. This duty ratio is then adjusted to achieve different brightness levels.

In both CCR dimming and PWM dimming, however, the wavelength of the light emitted from the LED varies or shifts from the emitted wavelength provided at full power (current), resulting in a perceptible color change of the emitted light, which is highly unsuited for many if not most applications. Often, this shift becomes particularly noticeable in low brightness when dimming is typically used.

Figure 1B:
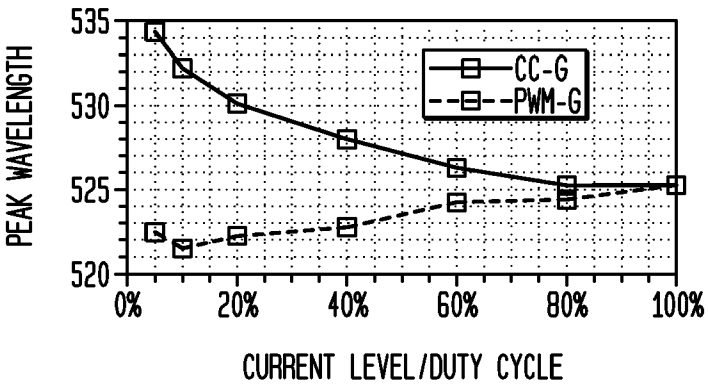
Figure 1C:
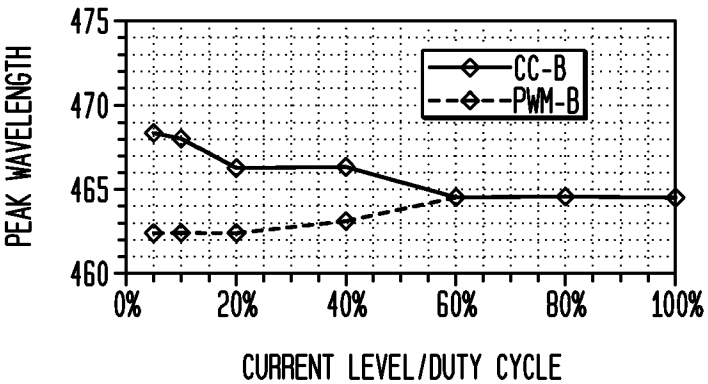
Figure 1D:
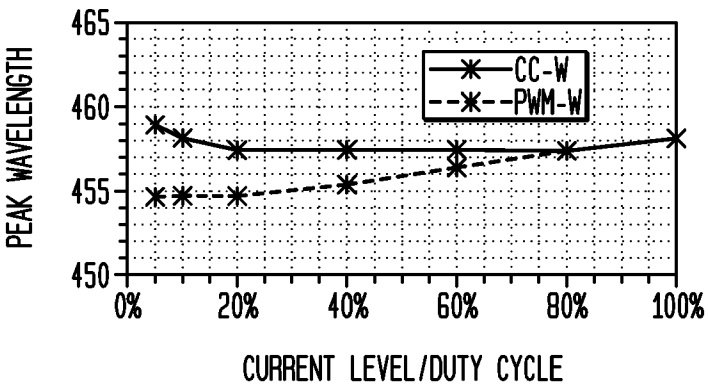
Figure 2A:
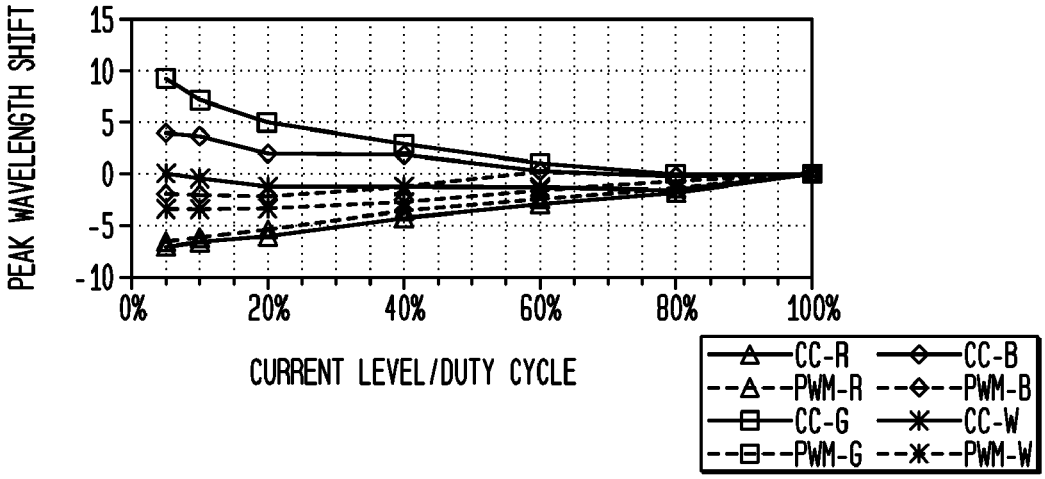
FIGS. 2A, 2B, and 2C, are prior art graphical diagrams illustrating the peak wavelength of light emitted as a function of current level (for CCR) and duty cycle (for PWM), for red, green, blue, and white LEDs, from respective LED manufacturers.
Figure 2B:
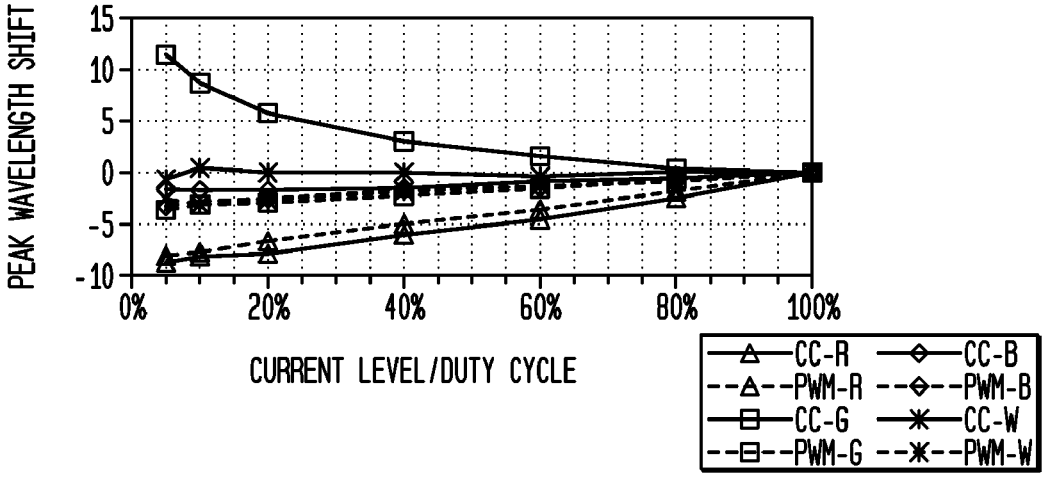
Figure 2C:
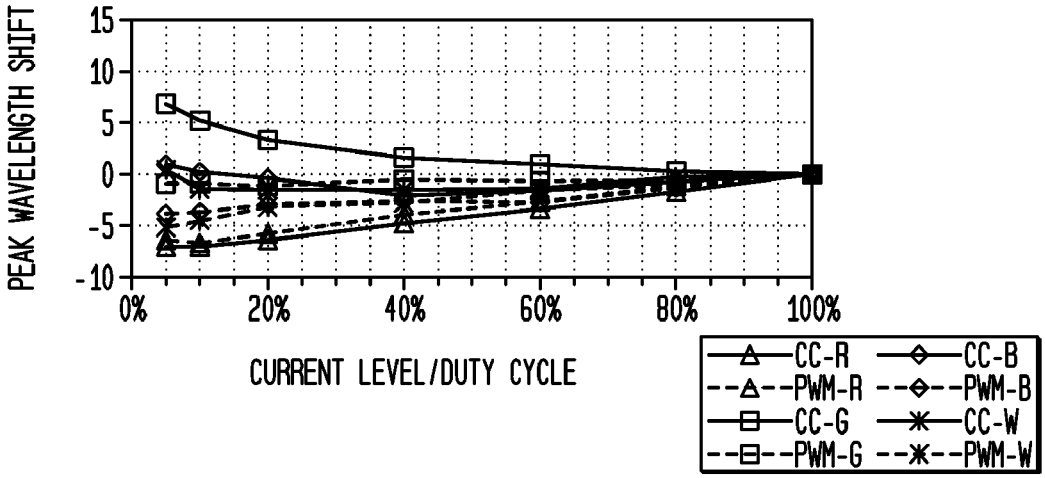

FIG. 1, divided into FIGS. 1A, 1B, 1C, and 1D, are prior art graphical diagrams illustrating the peak wavelength of light emitted as a function of current level (for CCR) and as a function of duty cycle (for PWM), respectively for red, green, blue, and white LEDs. FIG. 2, divided into FIGS. 2A, 2B, and 2C, are prior art graphical diagrams illustrating the peak wavelength of light emitted as a function of current level (for CCR) and as a function of duty cycle (for PWM), for red, green, blue, and white LEDs, respectively, from different LED manufacturers. As illustrated in FIGS. 1 and 2, for some color LEDs, the CCR dimming increases the wavelength of the light emitted, while the PWM dimming decreases the wavelength of the light emitted. FIG. 1B, for example, shows that for low brightness when dimming is used for the green InGaN LEDs, CCR dimming increases the wavelength of the light emitted by approximately 10 nm. When PWM dimming is used for the same type and color of LED, the wavelength of the light emitted decreases by approximately 4 nm. Either case is, at times, unacceptable for many applications, perhaps because it affects color mixing or changes the desired color. Similarly, blue LEDs and phosphor-coated white LEDs exhibit the same corresponding wavelength shifts when dimming: for CCR, the wavelength increases, while for PWM, the wavelength decreases, as illustrated in FIGS. 1C and 1D. For red LEDs, both CCR and PWM dimming decrease the wavelength of the light emitted, as illustrated in FIG. 1A. Similar corresponding wavelength shifts for CCR and PWM are also found consistently across colors of LEDs fabricated by different manufacturers, as illustrated in FIGS. 2A, 2B, and 2C.

FIG. 3, divided into FIGS. 3A and 3B, are prior art graphical diagrams illustrating the peak wavelength of light emitted, respectively, from a red LED (FIG. 3A) and a green LED (FIG. 3B), as a function of current level (for CCR) and duty cycle (for PWM), and also as a function of junction temperature using both CCR and PWM. As illustrated in FIG. 3, the peak wavelengths of LEDs are also functions of junction temperature, in addition to types of current control or modulation. For CCR and PWM with red LEDs, the spectrum shifts are similar as a function of junction temperature of the LEDs, showing a wavelength increase with increasing temperature. For Green LEDs (and, although not separately illustrated, also for blue LEDs and white phosphor-coated LEDs), different electrical biasing techniques also produce divergent wavelength responses with temperature: CCR peak wavelength decreases with increasing junction temperature, while PWM peak wavelength tends to increase with increasing junction temperature. In addition, luminous efficacy also differs in the two methods.

In accordance with representative embodiments of the disclosure, the intensity (brightness) of LED system is controlled while maintaining the overall spectrum or range of its wavelength emission substantially constant or, more particularly, providing that any resulting wavelength shift or color change is substantially undetectable by the average person. The representative embodiments provide an apparatus, method, and system which track (or determine) how the average LED current was (or will be) achieved, determine what resulting shift of wavelength emission is likely to occur, and then compensate for this shift, so that the overall spectrum of wavelength emission is substantially constant across different intensity levels, without additional color or wavelength sensor-based control systems.

The representative embodiments of the disclosure use the differences in the wavelength shifts created by different techniques of electrical biasing of a p-n junction of an LED device, which produce opposing (opposite sign) shifts of wavelength emission, under the same intensity conditions, to regulate more precisely the emitted spectrum of the LED for any such intensity level, and further, for a range of junction temperatures. The representative embodiments utilize a combination of two or more electrical biasing techniques which, if applied individually, would tend to produce wavelength shifts in opposing directions, such as one increasing the peak wavelength of the emitted spectrum, and the other decreasing the peak wavelength of the emitted spectrum. For example, for a given intensity level, the present disclosure utilizes a first electrical biasing technique which produces a first wavelength shift, combined with using a second electrical biasing technique which produces a second, opposing wavelength shift. Such a combination may be a superposition of the first electrical biasing and the second electrical biasing during the same time interval or period, or an alternating between the first electrical biasing and the second electrical biasing during successive time intervals periods, or the other types of combinations discussed above. This combination of at least two opposing electrical biasing techniques, such as the superposition of at least two opposing electrical biasing techniques or the alternation (at a sufficiently high frequency) between at least two opposing electrical biasing techniques, results in the corresponding wavelength shifts "effectively canceling" each other, i.e., the resulting spectrum or color is perceived to be constant by the average person (often referred to as a "standard" person in the field of color technology). For example, in a representative embodiment, both CCR (or another analog technique) and PWM techniques are utilized during a given period of time, rapidly alternating between the two methods, such that the resulting spectrum (or range) of emitted light is perceived to be substantially constant during the given time period. Also for example, in another representative embodiment, both CCR (or another analog technique) and PWM techniques are utilized as a superposition during a given period of time, applying both methods concurrently, such that the resulting spectrum (or range) of emitted light is perceived to be substantially constant during the given time period. The representative embodiments may also utilize more than two such opposing electrical biasing techniques, such as combining three or four techniques. The inventive concept utilizes a combination of at least two such opposing electrical biasing techniques so that a LED driver provides a corresponding electrical bias which results in an overall emitted spectrum (or color) which is perceived to be substantially constant by a typical human eye (i.e., any negative wavelength shift is effectively cancelled or balanced by a corresponding positive wavelength shift, resulting in an emitted spectrum (as a range of wavelengths) which is perceived to be substantially constant).

It should be noted that while, for ease of explanation, many of the examples and descriptions herein utilize PWM and CCR as representative electrical biasing techniques to produce opposing wavelength shifts in accordance with the present disclosure, with a resulting emitted spectrum which is perceived to be substantially or sufficiently constant by a typical human eye, depending upon selected tolerance levels, innumerable electrical biasing techniques are within the scope of the present disclosure, including without limitation PWM, CCR and other analog current regulation, pulse frequency modulation, pulse amplitude modulation, any type of pulse modulation, any type of waveform which can be utilized to produce a first wavelength shift opposing another, second wavelength shift, and any other time-averaged or pulse modulated biasing techniques or current control methodologies.

In addition, it should be noted that the combinations of first and second (or more) different electrical biasing techniques may be utilized for other purposes. For example, in conjunction with intensity variation, such combinations may be provided to a lighting system (200, 210, 225, 235, 245, 255, 265) to produce other dynamic lighting effects, to control color temperature, or to modify the emitted spectrum to, also for example, produce various architectural lighting effects. Also for example, particularly significant for intensity variation, such combinations may be provided to a lighting system (200, 210, 225, 235, 245, 255, 265) in such a manner that flicker is substantially reduced or eliminated. In addition, intensity and color (color temperature) can be controlled while controlling the resulting spectra, for any desired effect, such as dimming and color effects.

For a combination of at least two opposing electrical biasing techniques which are applied alternately (rather than a concurrent superposition), the percentage of time (e.g., which may be a given number of clock cycles) in which the LED is driven in each opposing mode depends on the desired regulation. Using a green LED, for example, PWM dimming results in a decrease of the peak wavelength by 4 nm, while for the same dimming (intensity) condition, CCR dimming results in an increase of the peak wavelength by 8 nm. The LED driver is controlled so that it regulates the amount of time during which there is a negative 4 nm shift (in PWM dimming) compared to the amount of time in which there is a positive 8 nm shift (in CCR dimming). Using an overly simplistic example for purposes of explanation, this might mean maintaining the PWM dimming time period to be twice as long as the CCR dimming time period, during a given interval or modulating period, and then rapidly alternating between these dimming techniques for their respective durations during each successive modulating period. The inventive concept also applies to any LED of any color, e.g., different colored LEDs such as red, green, blue, amber, white, etc., from any manufacturer, provided that the two (or more) selected modulation or other current control methods produce wavelength shifts in opposite directions. Representative current or voltage waveforms (or biasing signals) for control of wavelength and perceived color emission are illustrated and discussed in greater detail below with reference to FIGS. 4-16.

FIG. 4 is a graphical diagram illustrating a first representative current or voltage waveform (or biasing signal) for control of wavelength and perceived color emission in accordance with the teachings of the present disclosure. As an example illustrated in FIG. 4, for a dimming intensity of 80% of full intensity, PWM is applied for a first modulating period of $T_1$, which is 80% of the pulse width modulation period applicable to full power (intensity), followed by CCR being applied (at 80% of the peak value which would be applicable to full power (intensity)) for a second modulating period of $T_2$. The overall modulating period (T) is then repeated for the duration of the selected lighting intensity, as illustrated. As discussed in greater detail below, both the first and second (or more) modulating periods $T_1$ and $T_2$ and peak values may be predetermined in advance or may be determined (e.g., calculated) in real time, based upon calibration data which has been input and stored in the representative apparatus and system embodiments of the disclosure, to provide an overall resulting emitted spectrum (or color) which is perceived to be substantially or sufficiently constant by a typical human eye, depending upon selected tolerance levels. For example, the overall resulting emitted spectrum may be within selected tolerance levels, sufficient for a selected purpose, application or cost, without necessarily being completely constant as measured with a spectrophotometer.

Figure 6:
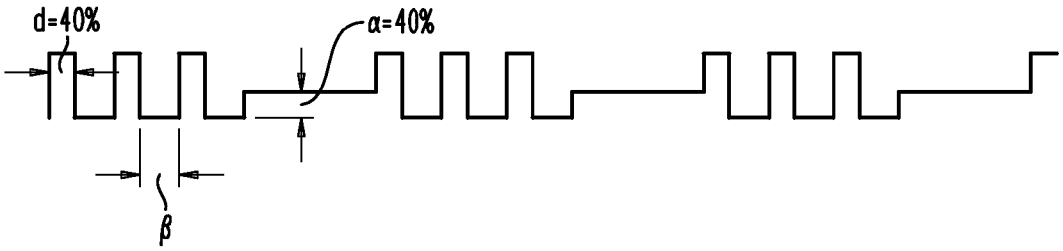
FIG. 6 is a graphical diagram illustrating a third representative current or voltage waveform (or biasing signal) for control of wavelength and perceived color emission in accordance with the teachings of the present disclosure.

FIGS. 5 and 6 are graphical diagrams illustrating second and third representative current or voltage waveforms (or biasing signals) for control of wavelength and perceived color emission in accordance with the teachings of the present disclosure. As an example illustrated in FIGS. 5 and 6, for a dimming intensity of 60% and 40% of full intensity, respectively, PWM is applied for three PWM modulating cycles, each having a modulating period of ⅓ $T_1$, each of which is respectively 60% and 40% of the pulse width modulation period applicable to full power (intensity), resulting in a first modulating period of $T_1$, followed by CCR being applied (at respectively 60% and 40% of the peak value which would be applicable to full power (intensity)) for a second modulating period of $T_2$. Also in contrast with the dual modulation illustrated in FIG. 4, in FIGS. 5 and 6 the second modulation period of $T_2$ has a longer duration, and may be equivalent to maintaining CCR for a larger number of clock cycles. The overall modulating period (T) (which also has a longer duration in FIGS. 5 and 6) is then repeated for the duration of the selected lighting intensity, as illustrated. As mentioned above and as discussed in greater detail below, both the first and second (or more) modulating periods $T_1$ and $T_2$ and peak values may be predetermined in advance or may be determined (e.g., calculated) in real time, based upon calibration data which has been input and stored in the representative apparatus and system embodiments of the disclosure, to provide an overall resulting emitted spectrum (or color) which is perceived to be substantially or sufficiently constant by a typical human eye, also depending upon selected tolerance levels. In addition, all of the various switching or modulating frequencies may also be similarly calibrated, calculated, or otherwise determined for a selected intensity, for example, for a selected modulation period T, providing for variable and/or multiple PWM modulating cycles and CCR modulating cycles within the same overall modulation period T.

Figure 7:
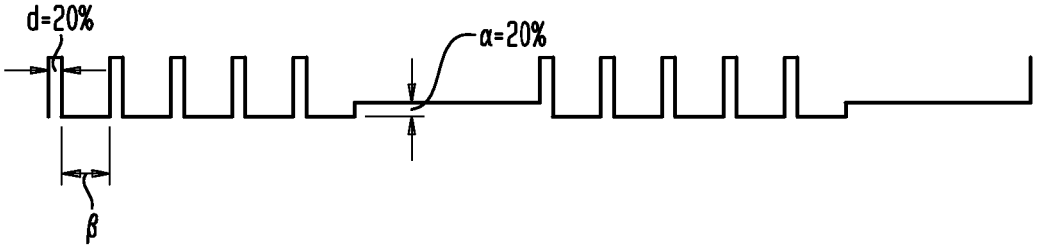
FIG. 7 is a graphical diagram illustrating a fourth representative current or voltage waveform (or biasing signal) for control of wavelength and perceived color emission in accordance with the teachings of the present disclosure.

Similarly, FIG. 7 is a graphical diagram illustrating a fourth representative current or voltage waveform (or biasing signal) for control of wavelength and perceived color emission in accordance with the teachings of the present disclosure. As an example illustrated in FIG. 7, for a dimming intensity of 20% of full intensity, PWM is applied for five PWM modulating cycles, each having a modulating period of ⅕ $T_1$, each of which is 20% of the pulse width modulation period applicable to full power (intensity), resulting in a first modulating period of $T_1$, followed by CCR being applied (at 20% of the peak value which would be applicable to full power (intensity)) for a second modulating period of $T_2$. Also in contrast with the dual modulation illustrated in FIG. 4, in FIG. 7 the second modulation period of $T_2$ has a longer duration, and may be equivalent to maintaining CCR for a larger number of clock cycles. The overall modulating period (T) (which also has a longer duration in FIG. 7) is then repeated for the duration of the selected lighting intensity, as illustrated. Again, both the first and second (or more) modulating periods $T_1$ and $T_2$ and peak values may be predetermined in advance or may be determined (e.g., calculated) in real time, based upon calibration data which has been input and stored in the representative apparatus and system embodiments of the disclosure, to provide an overall resulting emitted spectrum (or color) which is perceived to be substantially or sufficiently constant by a typical human eye, also depending upon selected tolerance levels. In addition, all of the various switching or modulating frequencies may also be similarly calibrated, calculated or otherwise determined for a selected intensity, for example, for a selected modulation period T, providing for variable and/or multiple PWM modulating cycles and CCR modulating cycles within the same overall modulation period T.

In addition, for many applications, combinations of red, green, and blue LEDs may be utilized, and may each be controlled independently, such as to provide light emission which is perceived as white, or to produce any desired color effect, or to produce any other dynamic lighting effect, from dimming to color control, for example. Typically, separate arrays of each color such as red, green, and blue are utilized, with each array comprising one color, and with each array being separately controlled. The various modulating periods, duty cycles, and peak current values, for example, may then be determined for each LED array on the basis of the overall, desired effect which is to be provided by such combinations of different colored LEDs. For example, because both CCR and PWM result in a wavelength decrease with dimming of red LEDs, other arrays of colored LEDs may be modulated differently such as to increase the relative amount of green light present in the overall reduced intensity emission, such that the resulting color spectrum may have more of a perceived yellow component, rather than red, and any resulting color change may be less perceptible to the average person. Conversely, in other representative embodiments, red LEDs may be modulated comparatively less to avoid wavelength shifting for that portion of the spectrum, with overall light intensity controlled by the dual modulation (e.g., alternating CCR and PWM) of other colored LEDs. In other representative embodiments, the various arrays of colored LEDs may be manipulated to provide a wide variety of chromatic effects. Numerous variations will be apparent and all such variations are within the scope of the present disclosure.

To provide for intensity adjustment (dimming) according to a first representative embodiment of the disclosure, calibration information concerning expected wavelength shifts, for a given intensity and junction temperature, for a selected type of LED (e.g., a selected color from a selected manufacturer), is obtained such as through a statistical characterization of the LEDs under selected intensity and temperature conditions. Using the calibration information, biasing techniques are selected, and then the lighting system designer may theoretically predict the mixing of these techniques to produce the desired effect, such as a substantially constant emitted spectrum under different intensity conditions. The result of such predictive modeling will be a set of operational parameters or equations (typically linear equations), which are then stored in a memory (e.g., as a look up table ("LUT") or as coded equations, corresponding to intensity levels, temperature, lighting effects, etc.). In operation, such parameters and/or equations are retrieved from memory and are utilized by a processor to generate corresponding control signals to provide the combined electrical biasing (superposition or alternating) to produce the predicted or desired effect. For the alternating technique, for example, these may be control signals to generate the selected first modulation (or current control) to the LED (as a first electrical biasing technique) at a selected first frequency and for a first time interval (e.g., period $T_1$) (typically determined as a corresponding number of clock cycles), followed by providing the selected second modulation (or current control) to the LED (as a second electrical biasing technique) at a selected second frequency and for a second time interval (e.g., period $T_2$), and repeatedly alternating between the first and second types of modulation (or current control) for their respective first and second time intervals (i.e., repeating the first and second types of modulation each overall period T). In a second representative embodiment, such calibration information is also predetermined and stored in a memory, and is then utilized by the processor to select or determine the types of modulation (or current control), their combination (e.g., superposition or alternation), and their respective durations (time intervals) to be used for driving the LEDs. Using either the first or second embodiments, with the resulting combination of electrical biasing techniques (e.g., modulation (or current control)), the LEDs are driven such that the total wavelength shift (on average) during a selected interval is substantially close to zero (or another selected tolerance level), i.e., the overall emitted spectrum is perceived to be substantially constant or otherwise within a selected tolerance.

Using a green LED device as an example, and using the data of FIG. 1B, a table may be composed to illustrate how to mix first and second types of modulation to create a dual modulation or other form of average current control technique to have wavelength emissions which are perceived to be substantially constant or otherwise within a selected tolerance. In the first column, the variable "D" refers to the intensity percentage compared to full intensity (100%), variable "d" refers to the pulse width for PWM as a percentage compared to full intensity (100%), and variable "α" refers to the peak current for CCR as a percentage compared to full intensity (100%). Due to the similarity of the empirical responses for this particular type and color of LED at an 80% intensity, it may not necessary to compensate any color shift by alternating CCR(α) and PWM (d) dimming within a single overall modulation period T. For increased dimming, (lower emitted light intensity (D less than 80%)), TABLE 1 illustrates representative mixing techniques, for first and second types of modulation that could be used to achieve the desired LED current, with the first and second modulation periods $T_1$ and $T_2$ provided as a number of unit modulating cycles (which may be a corresponding number of clock cycles).

TABLE 1

| D % | d % | Cycles per modulation period $T_1$ | α % | Cycles per modulation period $T_2$ | FIG. |
|---|---|---|---|---|---|
| 80 | 80 | 1 | 80 | 1 | 4 |
| 60 | 60 | 3 | 60 | 2 | 5 |
| 40 | 40 | 3 | 40 | 2 | 6 |
| 20 | 20 | 5 | 20 | 3 | 7 |
| 10 | 10 | 7 | 10 | 3 | — |

Figure 8:
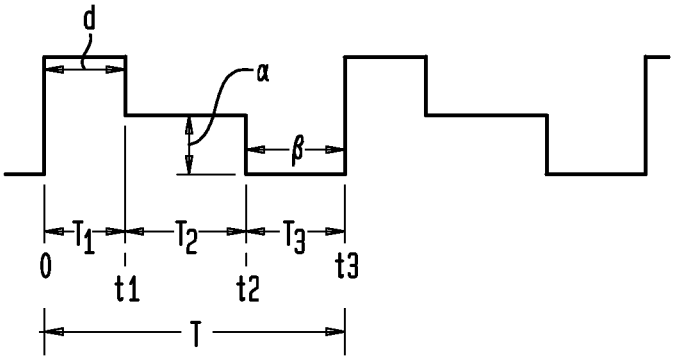
FIG. 8 is a graphical diagram illustrating a fifth representative current or voltage waveform (or biasing signal) for control of wavelength and perceived color emission in accordance with the teachings of the present disclosure.

There are innumerable additional ways to implement any selected first and second (or more) modulation patterns, such as the alternation between PWM and CCR. For example, FIG. 8 is a graphical diagram illustrating a fifth representative current or voltage waveform (or biasing signal) for control of wavelength and perceived color emission in accordance with the teachings of the present disclosure. As illustrated in FIG. 8, for example, the two PWM and CCR signals may be combined in additional orders, as a form of superposition (e.g., piece-wise or time interval-based superposition), for different portions of the overall modulation period T, with the modulation period $T_1$ for PWM split into two different portions (d and β). Continuing with the example, the representative current or voltage waveform (or biasing signal) comprises the pulse portion of PWM for the pulse width of d, followed by CCR for the duration $T_2$, followed by the non-pulse (zero current) portion of PWM for the duration β (in which $d+\beta=T_1$). In this case, as illustrated, the various time intervals t1, t2 and t3 may be adjusted to provide corresponding dimming and simultaneously regulate emitted wavelengths, where d is the duty ratio of peak electrical biasing, a is the amplitude modulation ratio, and β is duty cycle ratio during which no forward biasing is applied to LED. On each time interval, the LED wavelength emission changes, and the sensor or eye would see an approximate "average" of these, providing an overall emitted spectrum which is perceived to be substantially constant or otherwise within a selected tolerance.

As mentioned above, the various references to a "combination" of electrical biasing techniques should also be interpreted broadly, to include any type or form of combining, grouping, blending, or mixing, as discussed above and below and as illustrated in the various drawings, such as an additive superposition, as piece-wise superposition, an alternating, an overlay, or any other pattern comprised of or which can be decomposed into at least two different biasing techniques. For example, the various waveforms illustrated in FIGS. 4-16 may be equivalently described as a wide variety of types of combinations of at least two different waveforms, including piece-wise combinations (e.g., FIGS. 12 and 15), alternating combinations (FIGS. 4-15), additive superpositions (FIGS. 13 and 14), or piece-wise superpositions (FIGS. 4-15). For example, referring to FIG. 8, the illustrated waveform may be considered a piece-wise superposition of PWM in the interval $(0, t_1)$, CCR in the interval $(t_1, t_2)$, and no biasing (or the zero portion of the PWM duty cycle) in the interval $(t_2, t_3)$. Similarly, referring to FIG. 11, the illustrated waveform may be considered an additive superposition of PWM with CCR, with the CCR providing a constant minimum value, and with the PWM adding to provide the illustrated pulses. It should be noted that the various control signals discussed below, such as from a controller 230 to an LED driver 300, are likely to provide directives for piece-wise or time interval-based superpositions of opposing biasing techniques, such as PWM of a selected duty cycle and selected peak amplitude for 100 μs (e.g., from time $t_1$ to $t_2$), constant current having a selected amplitude for 150 μs (e.g., from time $t_2$ to $t_3$), no biasing for 50 μs (e.g., from time $t_3$ to $t_4$), etc.

According to another embodiment of the disclosure, for superposition of two opposing techniques during the same time interval (or, equivalently, a modulation period) or during different, successive time intervals (e.g., $T_1$ and $T_2$ modulation periods), an analytical relationship is used between modulation techniques to provide appropriate compensation for wavelength shifts at decreased intensity levels. The general relationship between the intensity adjustment "D", on the one hand, and "d," "α," and "β," on the other hand, to compensate color shift may be described as (Equation 1):

$$\alpha = k_1\beta,$$

where $k_1$ is a linear coefficient <1; and (Equation 2):

$$d = k_2\alpha(1-d-\beta),$$

where $k_2$ is the ratio of averaged biasing voltage or current of PWM and CCR dimming to compensate the color shift, and is typically a specification which may be able to be supplied by an LED manufacturer or which may be determined empirically, such as through a calibration process (e.g., as illustrated in FIGS. 1, 2 and 3). Then (Equation 3):

$$D = d + \alpha(1-d-\beta),$$

and solving Equation 3, using Equations 1 and 2 provides (Equation 4):

$$d = \frac{k_2}{1+k_2}D$$

and (Equation 5):

$$\alpha = \frac{d}{k_2(1-d-\beta)}.$$

A representative superposition of biasing techniques for such an analytical approach is illustrated and discussed below with reference to FIG. 16.

Figure 9:
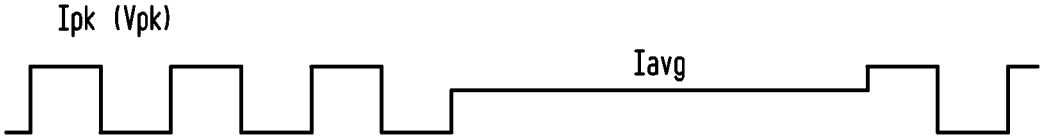
FIG. 9 is a graphical diagram illustrating a sixth representative current or voltage waveform (or biasing signal) for control of wavelength and perceived color emission in accordance with the teachings of the present disclosure.
Figure 10:
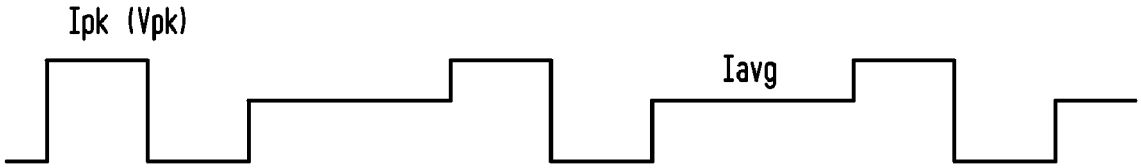
FIG. 10 is a graphical diagram illustrating a seventh representative current or voltage waveform (or biasing signal) for control of wavelength and perceived color emission in accordance with the teachings of the present disclosure.
Figure 11:
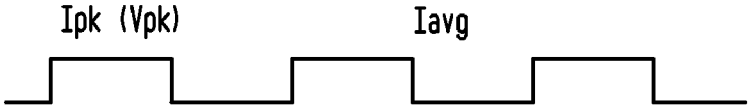
FIG. 11 is a graphical diagram illustrating an eighth representative current or voltage waveform (or biasing signal) for control of wavelength and perceived color emission in accordance with the teachings of the present disclosure.

FIGS. 9, 10 and 11 are graphical diagrams illustrating sixth, seventh, and eighth representative current or voltage waveforms (or biasing signals) for control of wavelength and perceived color emission in accordance with the teachings of the present disclosure. In accordance with the representative embodiments of the disclosure, there are innumerable ways to drive the LEDs to produce emitted light having a spectrum which is perceived to be substantially constant or otherwise within a selected tolerance, such as the various representative current or voltage waverforms (or biasing signals) illustrated in FIGS. 9, 10, and 11. Numerous variations will be apparent and all such variations are within the scope of the present disclosure. For example, FIG. 9 illustrates an equal number of cycles for the alternation between PWM (illustrated as three cycles of pulsing of a peak biasing electrical parameter (voltage or current)) with three cycles of an average CCR. Also for example, FIG. 10 illustrates a comparatively fast switching option for such mixing, when an alternative technique is being used every second cycle. Also for example, FIG. 11 illustrates a representative compensation technique during which the alternating of first and second modulation techniques which produce opposing wavelength shifts is completed within each switching cycle. There are innumerable, if not an infinite number, of modulation patterns which may be employed in accordance with the present disclosure, and which may or may not coincide with the switching or dimming cycle of a switched mode LED driver, such as using an alternating or superposition combination every dimming cycle, every other dimming cycle, every second dimming cycle, every third dimming cycle, and all sub-combinations, such as using a first biasing technique for two switching cycles, a second biasing technique for three switching cycles, a third biasing technique for one switching cycle, a fourth biasing technique for five switching cycles, or alternating biasing techniques any equal or unequal number of dimming cycles, and so on, for example. In representative embodiments, a higher switching frequency may be desirable, providing greater control over dimming and allowing a wider range of intensities, such as dimming ratios from 1:10 to 1:100 to 1:1000, for example.

Figure 12:
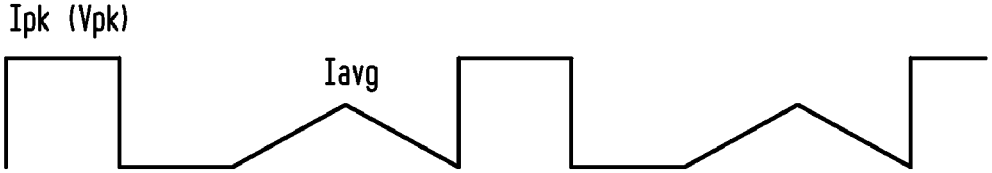
FIG. 12 is a graphical diagram illustrating a ninth representative current or voltage waveform (or biasing signal) for control of wavelength and perceived color emission in accordance with the teachings of the present disclosure.
Figure 13:
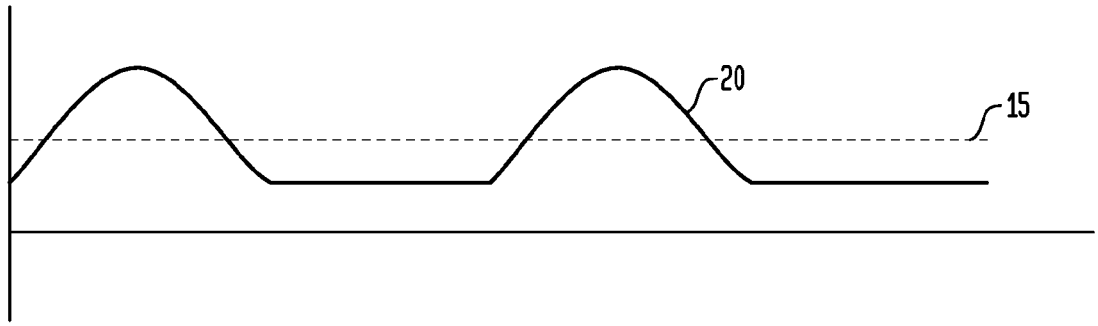
FIG. 13 is a graphical diagram illustrating a tenth representative current or voltage waveform (or biasing signal) for control of wavelength and perceived color emission in accordance with the teachings of the present disclosure.
Figure 14:
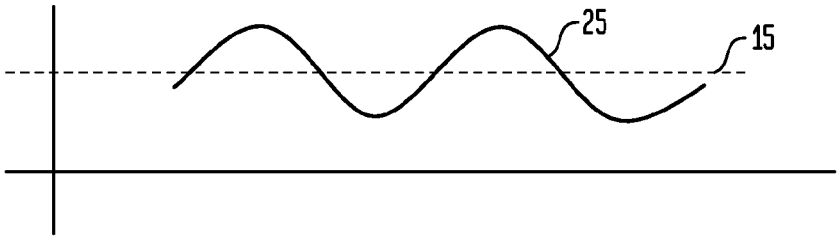
FIG. 14 is a graphical diagram illustrating an eleventh representative current or voltage waveform (or biasing signal) for control of wavelength and perceived color emission in accordance with the teachings of the present disclosure.

FIGS. 12-14 are graphical diagrams illustrating ninth, tenth, and eleventh representative current or voltage waveforms (or biasing signals) for control of wavelength and perceived color emission in accordance with the teachings of the present disclosure. There is no limitation to the waveforms or signals which may be utilized to provide such alternative biasing of the p-n junction of the LED. FIG. 12, for example, illustrates a PWM of a peak voltage (current), with a more triangular shape for current for an analog averaging technique. In accordance with the representative embodiments of the disclosure, and as illustrated in FIGS. 12-14, all that is there is a portion of the driving signal which can produce light emissions have wavelengths that are above the average value of wavelength emission produced at full intensity (e.g., full power or current), and that there is a portion of the driving signal which can produce light emissions have wavelengths that are below the average value of wavelength emission produced at full intensity (and not equal to zero). In addition, there can be no driving signal for some time interval (e.g., β), or there can be a driving signal (e.g., FIGS. 11, 13, 14). The net effect is that the human observer perceives or a sensor senses, for corresponding portions of time, at least two different wavelengths for the same LED, and the length of these time intervals is regulated to achieve a weighted average providing a desired peak wavelength of the emitted spectrum. Generally speaking, for example, such electrical (forward) biasing may be achieved by superposition of any AC signal on a DC signal, as illustrated in FIG. 13 (asymmetrical AC signal 20 superimposed with a DC signal 15) and FIG. 14 (symmetrical AC signal 25 superimposed with a DC signal 15), or by alternating a combination of forward current pulse modulation and analog regulation of forward current with any arbitrary waveform with an average component (FIG. 12). As another example, referring to FIG. 11, the AC signal may be a forward current pulse modulation with a peak current value at a high state and average current value at a low state.

Another embodiment of the disclosure is a method of driving a single LED or a plurality of identical LEDs with a variable intensity by biasing the p-n junction of a single LED or a plurality of identical LEDs with a superimposed AC signal on DC signal, where the positive and negative portions of the AC signal are being used to intentionally mix with corresponding portions of the DC signal in order to control the wavelength of the light. For this representative method, the AC and DC signals may be a current or a voltage, and the wavelengths of the emitted spectrum are being controlled to desired values, subject to different intensity conditions of the LED, such as, for example, the desired wavelengths of the emitted spectrum being kept substantially constant.

Figure 15:
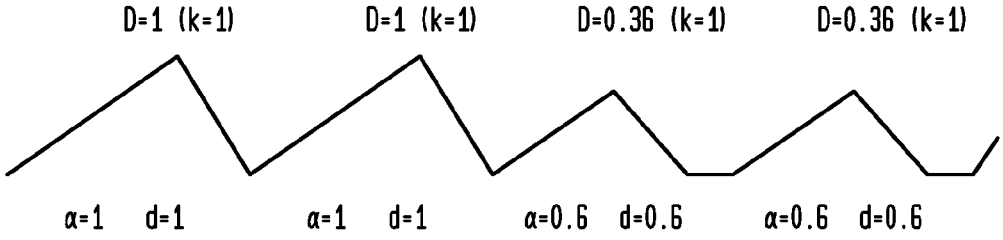
FIG. 15 is a graphical diagram illustrating a twelfth representative current or voltage waveform (or biasing signal) for control of wavelength and perceived color emission in accordance with the teachings of the present disclosure.

FIG. 15 is a graphical diagram illustrating a twelfth representative current or voltage waveform (or biasing signal) for control of wavelength and perceived color emission in accordance with the teachings of the present disclosure, and illustrates an additional analytical method for determining the first and second modulation periods for the first and second electrical biasing techniques, respectively. Typically the dimming cycle of a lighting system having at least one LED or a plurality of identical LEDs is orders of magnitude lower that the switching cycle of a switch mode LED driver. Another embodiment of the disclosure is a method of varying the intensity of at least a single LED or a plurality of identical LEDs with the emission wavelength control using a comparatively high frequency switch mode LED driver. Each of the first or second electrical biasing techniques, such as the analog regulation of forward biasing current (e.g., CCR) and pulse modulation of that current (e.g., PWM), are then being executed within every high frequency cycle, in order to compensate for the wavelength shift otherwise created when one biasing technique is being used, or they are executed alternatively for varying modulation periods, as discussed above.

Typically the dimming cycle of a lighting system, having at least one LED or a plurality of identical LEDs, is orders of magnitude lower than the switching cycle of a switch mode LED driver. Another embodiment of the disclosure is a method of varying the intensity of at least a single LED or a plurality of identical LEDs, with the emission wavelength control, using a high frequency switch mode LED driver. The analog regulation of forward biasing current and pulse modulation of that current are being executed within every high frequency cycle (e.g., FIG. 15), in order to compensate wavelength shift otherwise created when either one biasing technique is being used or they are used alternatively without consideration of wavelength compensation.

In accordance with a representative embodiment, a method of varying the intensity of at least a single LED or a plurality of identical LEDs, with the emission wavelength control utilizing a switch mode LED driver, utilizes selected biasing techniques which includes superposition of an analog regulation and pulse modulation of a forward current in each dimming cycle. Analytically, the relationship of dimming ratio "D" to analog ratio "α" and pulse modulation duty cycle "d" may be expressed as (Equation 6):

$$d = \sqrt{\frac{D}{k}},$$

and (Equation 7): $\alpha=\sqrt{Dk}$, in which "k" is a coefficient between "α" and "d" to balance the wavelength shift. Such a waveform is illustrated in FIG. 15, for a dimming cycle which corresponds to the cycle of a switch mode LED driver.

Figure 16:
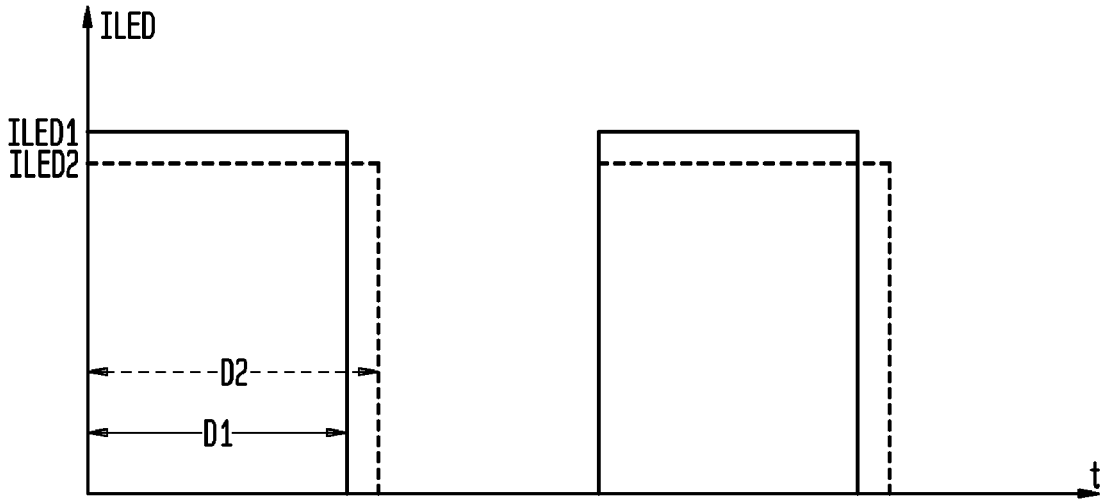
FIG. 16 is a graphical diagram illustrating a thirteenth representative current or voltage waveform (or biasing signal) for control of wavelength and perceived color emission in accordance with the teachings of the present disclosure.

FIG. 16 is a graphical diagram illustrating a thirteenth representative current or voltage waveform (or biasing signal) for control of wavelength and perceived color emission, in accordance with the teachings of the present disclosure, in which pulse width modulation ("PWM") and amplitude modulation are combined, as a superposition varying both duty cycle and amplitude, for brightness adjustment in accordance with the teachings of the disclosure. In this representative embodiment implementing brightness control (dimming) using a combination of at least two different electrical biasing techniques across the LEDs, such PWM and amplitude modulation (or constant current regulation ("CCR") are superimposed and applied concurrently, within the same modulation period (or, stated another way, the first and second modulation periods are coextensive or the same time periods). To decrease brightness, for the PWM portion (as the first electrical biasing technique), the duty cycle is decreased (e.g., from D1 to D2), and for the amplitude modulation (CCR) portion (as the second electrical biasing technique), the amplitude of the LED current is decreased (e.g., from ILED1 to ILED2), as illustrated in FIG. 16. In accordance with the representative embodiments, any of the representative controllers 250, 250A, 250B discussed below may be utilized to implement dimming by using both PWM and amplitude modulation, either alternating them in successive modulation intervals (as previously discussed) or combining them during the same modulation interval, as illustrated in FIG. 16. This inventive combination of at least two different electrical biasing techniques allows for both regulating the intensity of the emitted light while controlling the wavelength emission shift, from either or both the LED response to intensity variation (dimming technique) and due to p-n junction temperatures changes.

Figure 17:
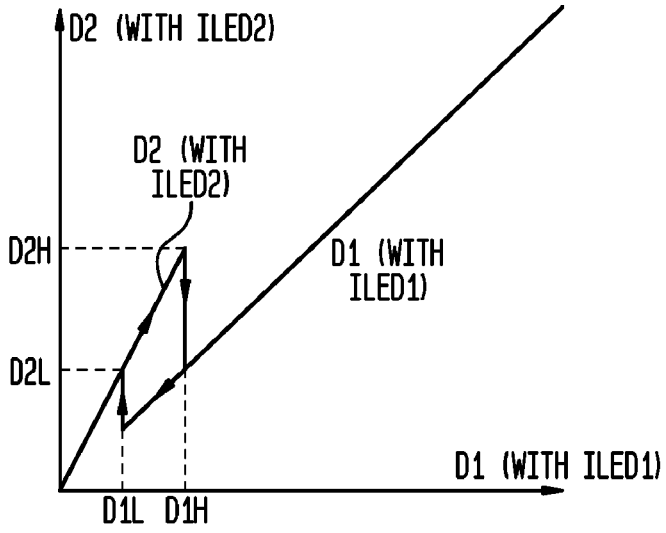
FIG. 17 is a graphical diagram illustrating a representative hysteresis for control of wavelength and perceived color emission in accordance with the teachings of the present disclosure.

FIG. 17 is a graphical diagram illustrating a representative hysteresis for control of wavelength and perceived color emission in accordance with the teachings of the present disclosure. In order to prevent jitter in the perceived emission, a hysteresis is implemented as illustrated in FIG. 17. When D1 comes from high brightness down to D1L, ILED1 is changed to ILED2 and D2L is used instead. When D2 comes up from low brightness to D2H, ILED2 is switched to ILED1 and D1H is used. The operating points (ILED1, D1L) have the same brightness (color) to (ILED2, D2L), and the same brightness applies to (ILED1, D1H) and (ILED2, D2H). Any of the representative controllers 250, 250A, 250B discussed below may be utilized to implement such a hysteresis for the superposition of at least two opposing electrical biasing techniques.

While representative embodiments of the disclosure discussed above have been derived primarily from the physical properties of a green LED device, e.g., TABLE 1 and as illustrated in FIG. 1B, it should be understood that the disclosure is not limited to a green LED device, but extends to any and all other types and colors of LEDs, such as blue and white LEDs, as well as any LED technology which may be characterized by alternative biasing techniques which can provide a wavelength shift in opposite directions with intensity variation, or temperature variation, or both.

Figure 18:
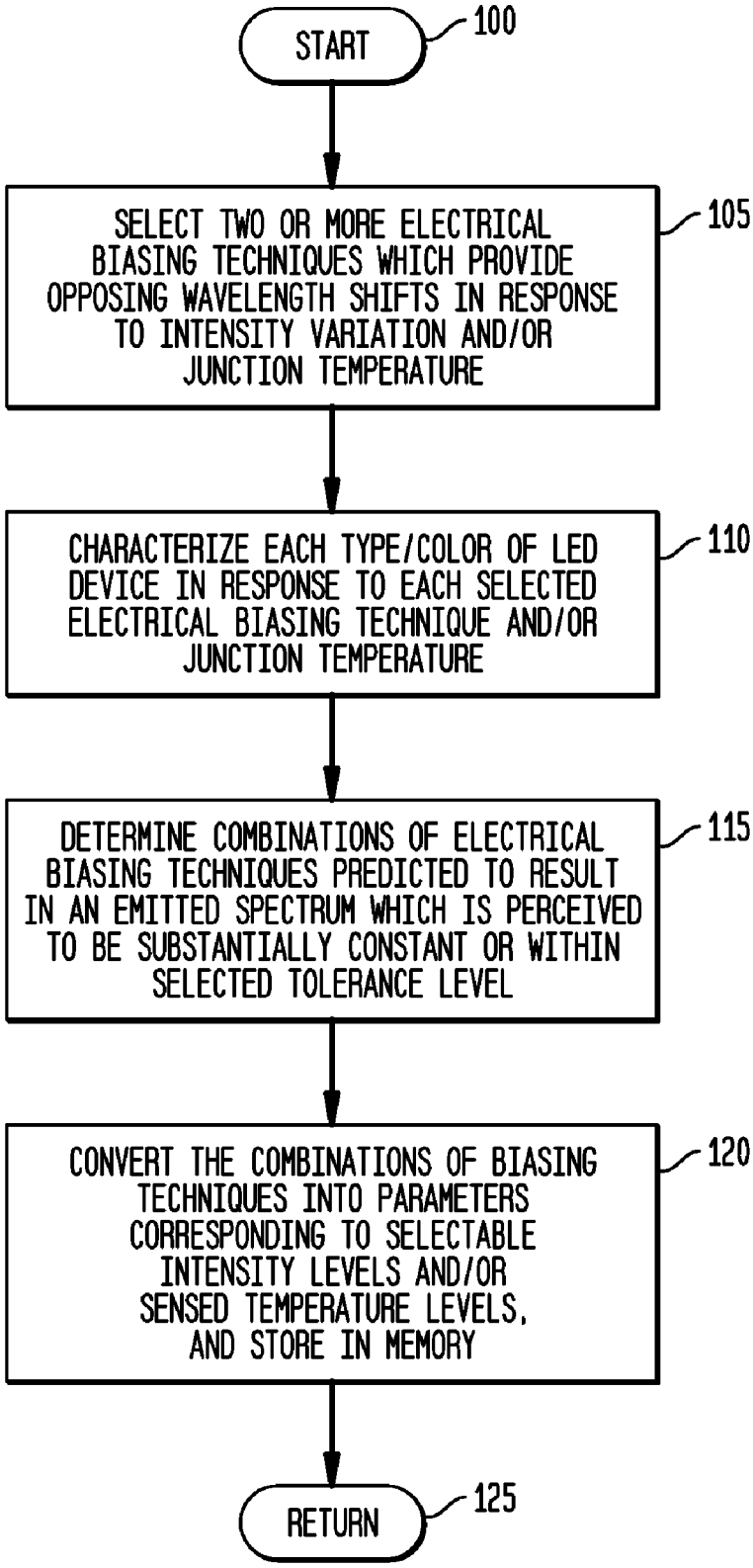
FIG. 18 is a flow chart diagram of a representative method embodiment, for a preoperational stage, for current regulation in accordance with the teachings of the present disclosure.

FIG. 18 is a flow chart diagram of a representative method embodiment, for a preoperational stage, for current regulation in accordance with the teachings of the present disclosure. In such a preoperational stage, parameters are determined for the selected LED devices which are to be regulated, for use in actual, subsequent operation of an LED lighting system. Beginning with start step 100, at least two (or more) electrical biasing techniques (e.g., PWM, PAM, PFM, CCR) are selected which can provide opposing wavelength shifts in response to intensity variation and/or junction temperature, step 105. Next, in step 110, the selected LED devices which are to be regulated are characterized, generally statistically and quantitatively, concerning emitted spectra (wavelengths) in response to or dependence upon the two or more different electrical biasing techniques at different intensity levels and/or junction temperatures, creating data such as that illustrated in the representative characterizations of FIGS. 1-3. For example, wavelength shift may be measured as a function of a plurality of intensity levels (100%, 90%, 80%) and also a plurality of junction temperatures. Junction temperature may be determined by measuring the actual junction itself, or by measuring ambient temperature or the LED case and calculating a junction temperature, based on losses inside the LED and thermal characteristics of the heat sink, for example and without limitation. In light of the spectral response to the electrical biasing techniques and/or junction temperature, in step 115, combinations of electrical biasing techniques are selected or determined, which are predicted (theoretically or empirically) to result in an emitted spectrum which is perceived to be substantially constant or within a selected tolerance level. For example, using the data of FIGS. 1-3, TABLE 1 illustrates theoretical predictions for selected combinations of PWM and CCR at selected intensity levels, and could be expanded to include junction temperatures, or both intensity levels and junction temperatures. The selected or determined combinations are then converted into parameters corresponding to selectable intensity levels and/or sensed temperature levels (with the parameters having a form which can be utilized by a processor or controller in creating control signals to a switched LED drive), and stored as parameters in a memory, step 120, such as the various parameters of D, d, $T_1$, $T_2$, $\alpha$, $\beta$, peak current values, average current values, duty ratios, number of cycles, and temperature parameters of TABLE 1 and FIGS. 4-8, and the preoperational stage of the method may end, return step 125. In representative embodiments, the parameters are stored as a look up table (LUT) or database in a memory 220 (FIG. 20), or stored in such a memory as parameters which can be utilized analytically by a processor or controller 230 to create control signals providing the electrical biasing techniques (e.g., PWM and CCR), such as in the form of linearized equations which are a function of intensity levels and/or temperature levels.

Figure 19:
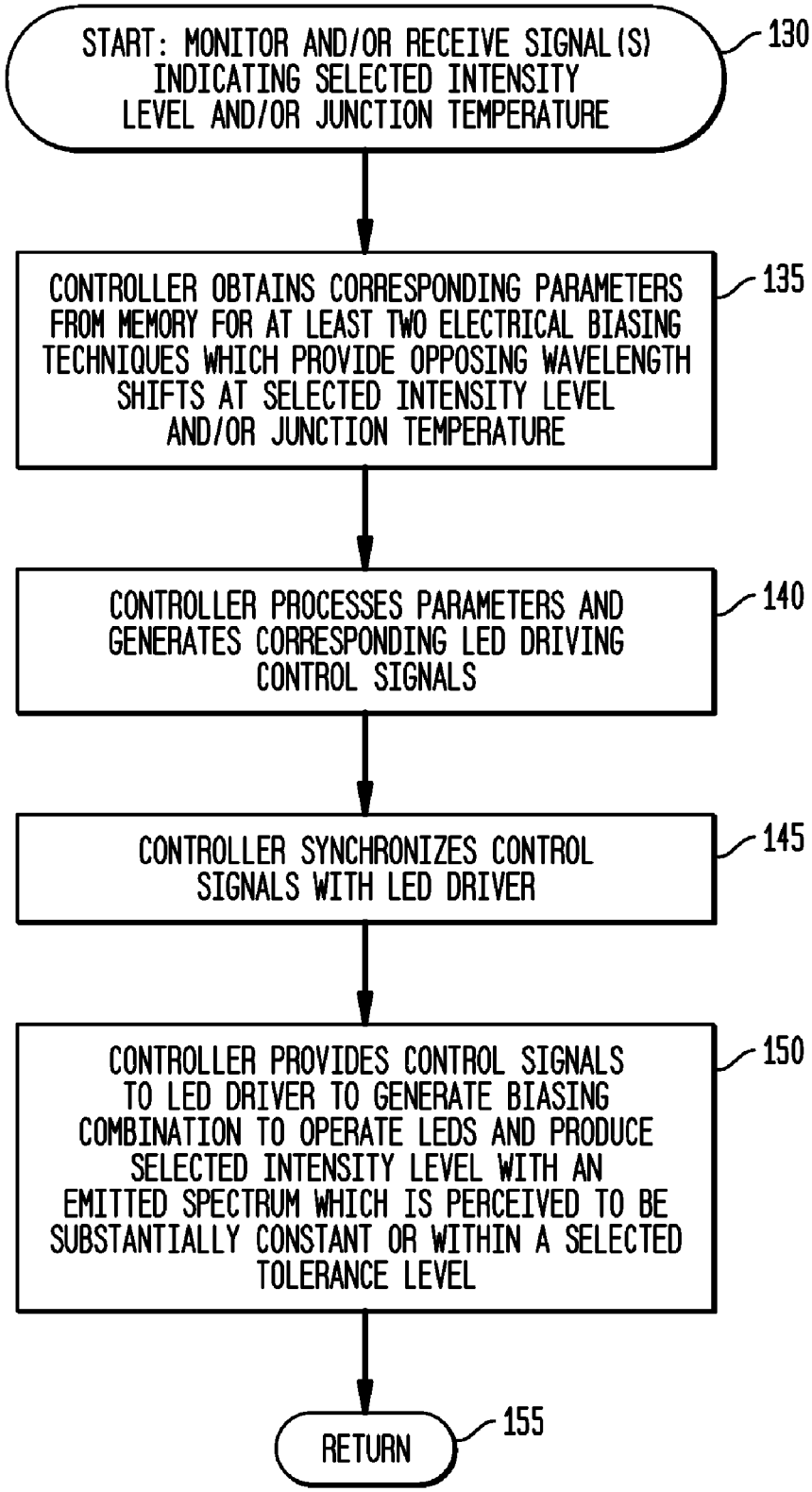
FIG. 19 is a flow chart diagram of a representative method embodiment, for an operational stage, for current regulation in accordance with the teachings of the present disclosure.

FIG. 19 is a flow chart diagram of a representative method embodiment, for an operational stage of an LED lighting system, for current regulation in accordance with the teachings of the present disclosure. Beginning with start step 130, the LED lighting system monitors and receives one or more signals indicating a selected intensity level and/or junction temperature. For example, an LED lighting system may acquire or receive an input signal addressed to a particular LED controller within the system from, optionally, a lighting system microprocessor, remote controller, phase modulation of AC input voltage controller, manual controller, network controller and any other means of communicating to a LED controller the requested level of intensity of at least a single LED or a plurality of LEDs. Such information may be provided, also for example, through a system interface (e.g., interface 215, FIG. 20) coupled to a user or system input (such as for changes in selected intensity levels) (e.g., using communication protocols such as DMX 512, DALI, IC-squared, etc.) and/or coupled to a temperature sensor for determining LED junction temperatures. Such input signals may also be monitored, such as by an LED controller, discussed below. Next, based on the input signals, the LED lighting system obtains (typically from a memory 220) corresponding parameters for at least two electrical biasing techniques which provide opposing wavelength shifts at the selected intensity level and/or sensed junction temperature, step 135. Obtaining the parameters may also be an iterative or analytical process. The retrieved, operational parameters are then processed or otherwise converted into control signals for (and usable by) the specific LED drivers to generate corresponding biasing for the specific type(s) LEDs of the lighting system, step 140, typically by a processor or controller 230, e.g., control signals which cause the LED drivers to produce the current or voltage waveforms illustrated in FIGS. 4-15. Such input electrical biasing control signals, for example, may indicate cycles times, on times, off times, peak current values, predetermined average current values, etc., and are designed for the specific type of LED driver circuitry employed in the lighting system. The control signals are then synchronized, step 145, to avoid a sudden increase or decrease in LED current which would be perceived to be a sudden change in intensity (brightening or darkening). The control signals are then provided to the LED driver to provide the selected intensity level with an emitted spectrum which is perceived to be substantially constant or within a selected tolerance level, step 150, which are then utilized by the LED driver to provide the time average modulating of a forward current or voltage of the LEDs corresponding to or conforming with the control signals of the desired biasing combination, to vary the LED intensity within the dimming cycle, and the method may end, return step 155.

It should be noted that this methodology is applicable to a single array of LEDs, such as a series-connected LEDs of one color, and applicable to a plurality of arrays of LEDs, such as a plurality of arrays of such series-connected LEDs, with each array having LEDs a selected color, such as an array of red LEDs, and array of blue LEDs, an array of green LEDs, an array of amber LEDs, an array of white LEDs, and so on. Using the various parameters corresponding to a selected intensity level or sensed temperature, corresponding control signals are generated (by one or more controllers) to the corresponding one or more drivers for each array to produce the combined electrical biasing for the array (e.g., a first combination for the green array, a second combination for the green array, and so on), which then produce the desired, overall lighting effect, such as a reduced intensity while maintaining the emitted spectrum within a predetermined tolerance.

Figure 20:
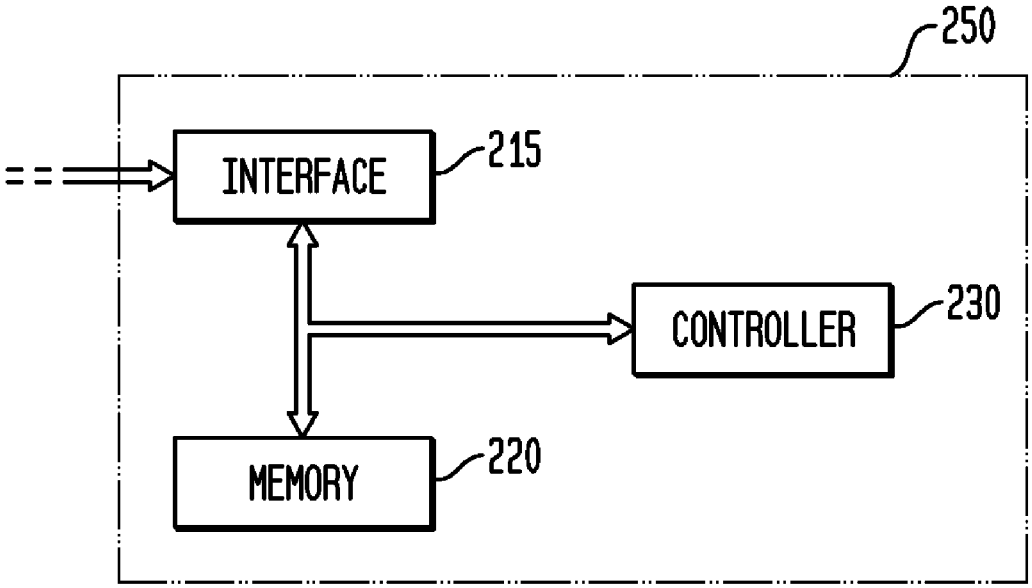
FIG. 20 is a block diagram of a representative first apparatus embodiment in accordance with the teachings of the present disclosure.

FIG. 20 is a block diagram of a representative first apparatus 250 embodiment in accordance with the teachings of the present disclosure. As illustrated in FIG. 20, the apparatus 250 comprises an interface 215, a controller 230, and a memory 220. The interface 215 is utilized for input/output communication, providing appropriate connection to a relevant channel, network or bus, for example, and the interface 215 may provide additional functionality, such as impedance matching, drivers and other functions for a wireline interface, may provide demodulation and analog to digital conversion for a wireless interface, and may provide a physical interface for the memory 220 and controller 230 with other devices. In general, the interface 215 is used to receive and transmit data, depending upon the selected embodiment, such as to receive intensity level selection data, temperature data, and to provide or transmit control signals for current regulation (for controlling an LED driver), and other pertinent information. For example and without limitation, the interface 215 may implement communication protocols such as DMX 512, DALI, IC-squared, etc. In other embodiments, the interface 215 may be minimal, for example, to interface merely with a phase modulation device (e.g., typical or standard wall dimmer) or standard bulb interface, such as an Edison socket.

The controller 230 (or, equivalently, a "processor") may be any type of controller or processor, and may be embodied as one or more controllers 230 (and/or 230A, 230B, as specific instantiations of a controller 230), adapted to perform the functionality discussed herein. As the term controller or processor is used herein, the controller 230 may include use of a single integrated circuit ("IC"), or may include use of a plurality of integrated circuits or other components connected, arranged or grouped together, such as controllers, microprocessors, digital signal processors ("DSPs"), parallel processors, multiple core processors, custom ICs, application specific integrated circuits ("ASICs"), field programmable gate arrays ("FPGAs"), adaptive computing ICs, associated memory (such as RAM, DRAM and ROM), and other ICs and components. As a consequence, as used herein, the term controller (or processor) should be understood to equivalently mean and include a single IC, or arrangement of custom ICs, ASICs, processors, microprocessors, controllers, FPGAs, adaptive computing ICs, or some other grouping of integrated circuits which perform the functions discussed below, with associated memory, such as microprocessor memory or additional RAM, DRAM, SDRAM, SRAM, MRAM, ROM, FLASH, EPROM or $E^2$PROM. A controller (or processor) (such as controller 230), with its associated memory, may be adapted or configured (via programming, FPGA interconnection, or hard-wiring) to perform the methodology of the disclosure, as discussed above and below. For example, the methodology may be programmed and stored, in the controller 230 with its associated memory (and/or memory 220) and other equivalent components, as a set of program instructions or other code (or equivalent configuration or other program) for subsequent execution when the processor is operative (i.e., powered on and functioning). Equivalently, when the controller 230 may be implemented in whole or part as FPGAs, custom ICs and/or ASICs, the FPGAs, custom ICs or ASICs also may be designed, configured and/or hard-wired to implement the methodology of the disclosure. For example, the controller 230 may be implemented as an arrangement of controllers, microprocessors, DSPs and/or ASICs, collectively referred to as a "controller," which are respectively programmed, designed, adapted or configured to implement the methodology of the disclosure, in conjunction with a memory 220.

The memory 220, which may include a data repository (or database), may be embodied in any number of forms, including within any computer or other machine-readable data storage medium, memory device or other storage or communication device for storage or communication of information, currently known or which becomes available in the future, including, but not limited to, a memory integrated circuit ("IC"), or memory portion of an integrated circuit (such as the resident memory within the controller 230 or processor IC), whether volatile or non-volatile, whether removable or non-removable, including without limitation RAM, FLASH, DRAM, SDRAM, SRAM, MRAM, FeRAM, ROM, EPROM or $E^2$PROM, or any other form of memory device, such as a magnetic hard drive, an optical drive, a magnetic disk or tape drive, a hard disk drive, other machine-readable storage or memory media such as a floppy disk, a CDROM, a CD-RW, digital versatile disk (DVD) or other optical memory, or any other type of memory, storage medium, or data storage apparatus or circuit, which is known or which becomes known, depending upon the selected embodiment. In addition, such computer-readable media includes any form of communication media which embodies computer-readable instructions, data structures, program modules, or other data in a data signal or modulated signal, such as an electromagnetic or optical carrier wave or other transport mechanism, including any information delivery media, which may encode data or other information in a signal, wired or wirelessly, including electromagnetic, optical, acoustic, RF or infrared signals, and so on. The memory 220 may be adapted to store various look up tables, parameters, coefficients, other information and data, programs or instructions (of the software of the present disclosure), and other types of tables such as database tables.

As indicated above, the controller 230 is programmed, using software and data structures of the disclosure, for example, to perform the methodology of the present disclosure. As a consequence, the system and method of the present disclosure may be embodied as software which provides such programming or other instructions, such as a set of instructions and/or metadata embodied within a computer-readable medium, discussed above. In addition, metadata may also be utilized to define the various data structures of a look up table or a database. Such software may be in the form of source or object code, by way of example and without limitation. Source code further may be compiled into some form of instructions or object code (including assembly language instructions or configuration information). The software, source code or metadata of the present disclosure may be embodied as any type of code, such as C, C++, SystemC, LISA, XML, Java, Brew, SQL and its variations (e.g., SQL 99 or proprietary versions of SQL), DB2, Oracle, or any other type of programming language which performs the functionality discussed herein, including various hardware definition or hardware modeling languages (e.g., Verilog, VHDL, RTL) and resulting database files (e.g., GDSII). As a consequence, a "construct," "program construct," "software construct," or "software," as used equivalently herein, means and refers to any programming language, of any kind, with any syntax or signatures, which provides or can be interpreted to provide the associated functionality or methodology specified (when instantiated or loaded into a processor or computer and executed, including the controller 230, for example).

The software, metadata, or other source code of the present disclosure and any resulting bit file (object code, database, or look up table) may be embodied within any tangible storage medium, such as any of the computer or other machine-readable data storage media, as computer-readable instructions, data structures, program modules, or other data, such as discussed above with respect to the memory 220, e.g., a floppy disk, a CDROM, a CD-RW, a DVD, a magnetic hard drive, an optical drive, or any other type of data storage apparatus or medium, as mentioned above.

FIG. 21 is a block diagram of a representative first lighting system 200 embodiment in accordance with the teachings of the present disclosure. The apparatus 250A of the system 200 is a more specific embodiment or instantiation of an apparatus 250, and also comprises an interface 215, a controller 230, and a memory 220, which are illustrated in greater detail as the more specific embodiments or instantiations of interface 215A, controller 230A, and memory 220A. The interface 215A, controller 230A, and memory 220A may be embodied and configured as described above, and will include the additional functionality and/or components described below. The apparatus 250A, which may be considered to be an "overall" LED controller, is a mixed signal system, which may receive input from a wide variety of sources, including open or closed-loop feedback of various signals and measurements from within the LED array driver circuit 300, as discussed in greater detail below. The apparatus 250A (LED controller) may be coupled within a larger system, such as a computer-controlled lighting system in a building (e.g., via microprocessor 51), and may interface with other computing elements via a defined user interface using a wide variety of data transmission protocols, such as DMX 512, DALI, IC squared, etc., as mentioned above.

The interface 215A is a standard digital defined interface, such as serial peripheral interface (SPI), or may be a proprietary interface, such that user settings are stored into memory 220A, implemented as registers 53 and 54, to set the desired output intensity 54, and the DIM Frame rate 53 of user updates to the output load. In other embodiments, the interface 215A may be much simpler, for example, to interface merely with a phase modulation device (e.g., typical or standard wall dimmer) or standard bulb interface, such as an Edison socket. The controller 230A contains a control and decode state machine logic block 55 that has input of the user data and decodes a combination of addresses that select the correct values for changing the output intensity and wavelength of the load LEDs 313. The look up tables (LUT) 57 (part of memory 220A) comprise preprogrammed non-volatile or volatile memory which contains the predetermined combinations of parameters or other values for N cycles, peak, duty, and amplitude "α", and any of the other parameters mentioned above. The memory 57 (part of memory 220A) is adapted to store various look up tables, parameters, coefficients, other information and data, programs or instructions, linearized equations (of the software of the present disclosure), and other types of tables such as database tables, as discussed above and below. The memory 220A may be embodied using any forms of memory previously discussed.

When there is a change in selected intensity, or upon system 200 start up (e.g., with default settings) (or a change in temperature), the parameters for a new intensity level (i.e., new values corresponding to a selected intensity) or parameters for a junction temperature are stored into registers (61, 62, 63, 64, 65, 66, 67, 68). The registers are pipelined for the apparatus 250A (LED controller) to accept new data asynchronously from the frame time. The registers outputs are selected by digital multiplexers 91, 93.

The controller 230A synchronizes the new values on a Frame signal ("Fsync"), generated by the Frame counter 72, which is programmed by the user via the DIM Frame Register 53. For example, the user selects the number of system clocks (80) desired for a DIM frame time. Every Fsync, new values are applied to the Digital-to-Analog Converters (DACs 92, 94) by digital multiplexers 91, 93. The DACs 92, 94 provide the correct analog value for a desired α and a desired peak (for PWM). The analog multiplexer 95 selects the desired amplitude or peak on the output by controlling a reference input 303 which goes to the regulator 301 of the LED driver 300.

The setting of "α" and peak are synchronized to the DIM frame, but the actual regulator reference 103 is controlled by the analog multiplexer 95 and it is synchronized to the switch cycles of the regulator 56, as such it can change on a cycle by cycle basis. These changes are based on a combination of Duty comparator 68 and a programmed number of cycles N.

The N cycle counter 71 and Cycle N comparator 65, and the Frame counter 72 and Duty comparator 68 change such that any combination of peak and amplitude and/or frame duty can be applied at different times in a given DIM time frame. The DIM Frame and cycle synchronization along with multi-registering is used to reduce the amount of output flicker to a minimum.

More specifically, in order to reduce flickering at the intensity level changes, the lighting system 200 includes at least one frame synchronization register to store the input electrical biasing control signals. The synchronized register is updated with new control signals beginning at each frame, providing a fixed period of time for synchronization with the switching frequency. This can be extended to control multiple LEDs independently, with additional frame synchronization registers corresponding to each additional LED array. For example, the apparatus 250A is structured to vary the intensity of at least one LED or plurality of identical LEDs with no corresponding optical output flickering by alternatively multiplexing the operational signals to the LED driver from a current set of operational signal registers, synchronously to the end of the current dimming frame counter, while programming asynchronously the second set of operational signal registers with the new operational signals and putting them in a queue to change their status at the end of the next dimming frame counter.

FIG. 22 is a block diagram of a representative second system 210 embodiment in accordance with the teachings of the present disclosure, which provides wavelength shift compensation due to both variable intensity and p-n junction temperature change. The second system 210 operates identically to the first system 200, except insofar as the temperature functionality is included within the system 210, and as otherwise noted below. In this embodiment, the apparatus 250B (LED controller) also interfaces to a temperature sensor 330, using a temperature input sensor interface 331 (e.g., also a digital serial bit stream interface such as SPI). In this embodiment, the control and decode state machine logic block 55 is also adapted to use both the temperature and user data (e.g., for selected intensity levels) to decode a combination of addresses and indexes that select the correct values for changing the output intensity and wavelength of the load LEDs 313, in response to any input selection of brightness levels and in response to any sensed temperature (from temperature sensor 330). The multi-dimensional look up tables (LUT) 57 comprise an array of preprogrammed non-volatile or volatile memory which contains the predetermined combinations of parameters or other values of N cycles, peak, duty, and amplitude (α), other parameters discussed above, and all indexed by a decoded temperature value and/or intensity level. The apparatus 250B (LED controller) otherwise functions similarly to the apparatus 250A (LED controller) previously discussed, but utilizing temperature feedback and utilizing parameter values which also include wavelength compensation as a function of LED junction temperature, in addition to intensity levels.

Figure 23:
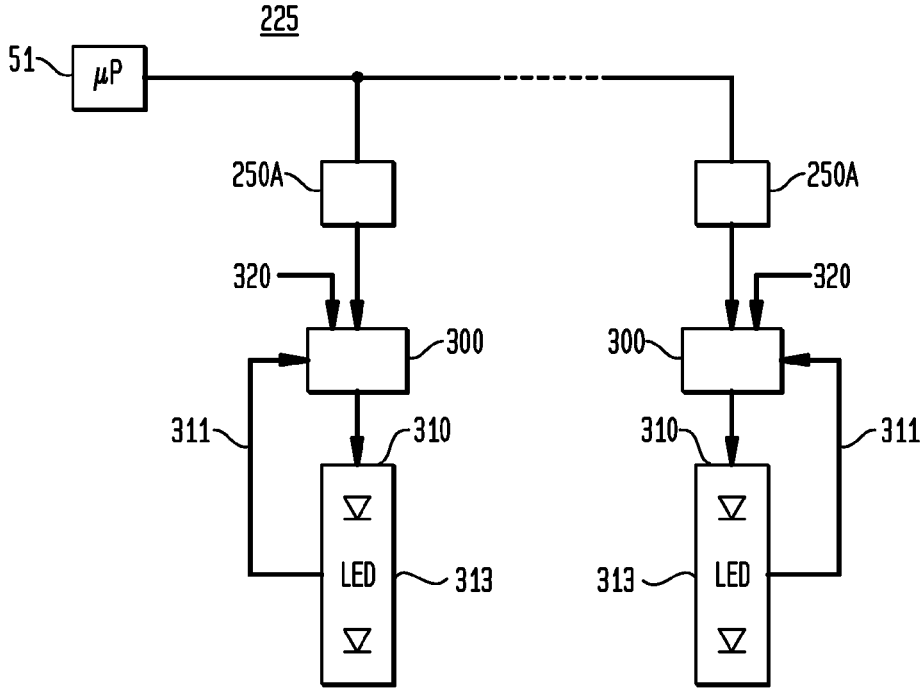
FIG. 23 is a block diagram of a representative third system embodiment in accordance with the teachings of the present disclosure.
Figure 24:
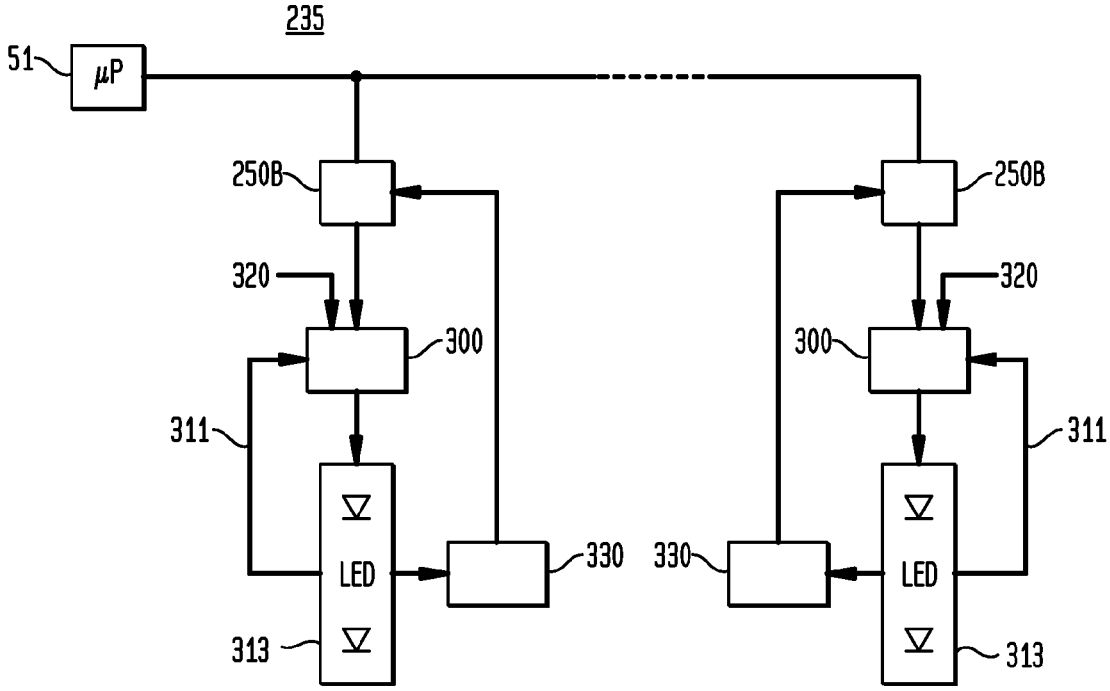
FIG. 24 is a block diagram of a representative fourth system embodiment in accordance with the teachings of the present disclosure.
Figure 25:
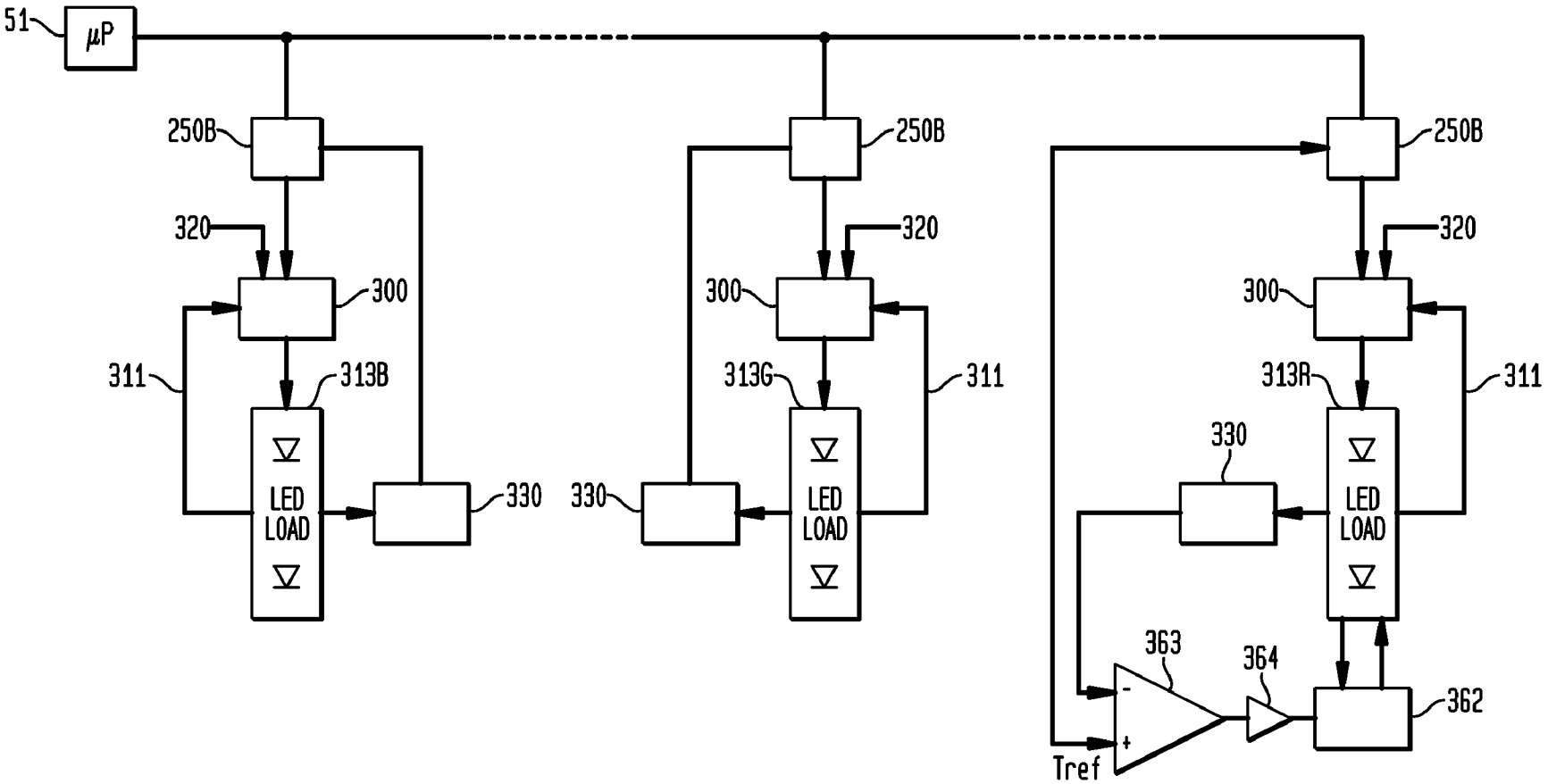
FIG. 25 is a block diagram of a representative fifth system embodiment in accordance with the teachings of the present disclosure.
Figure 26:
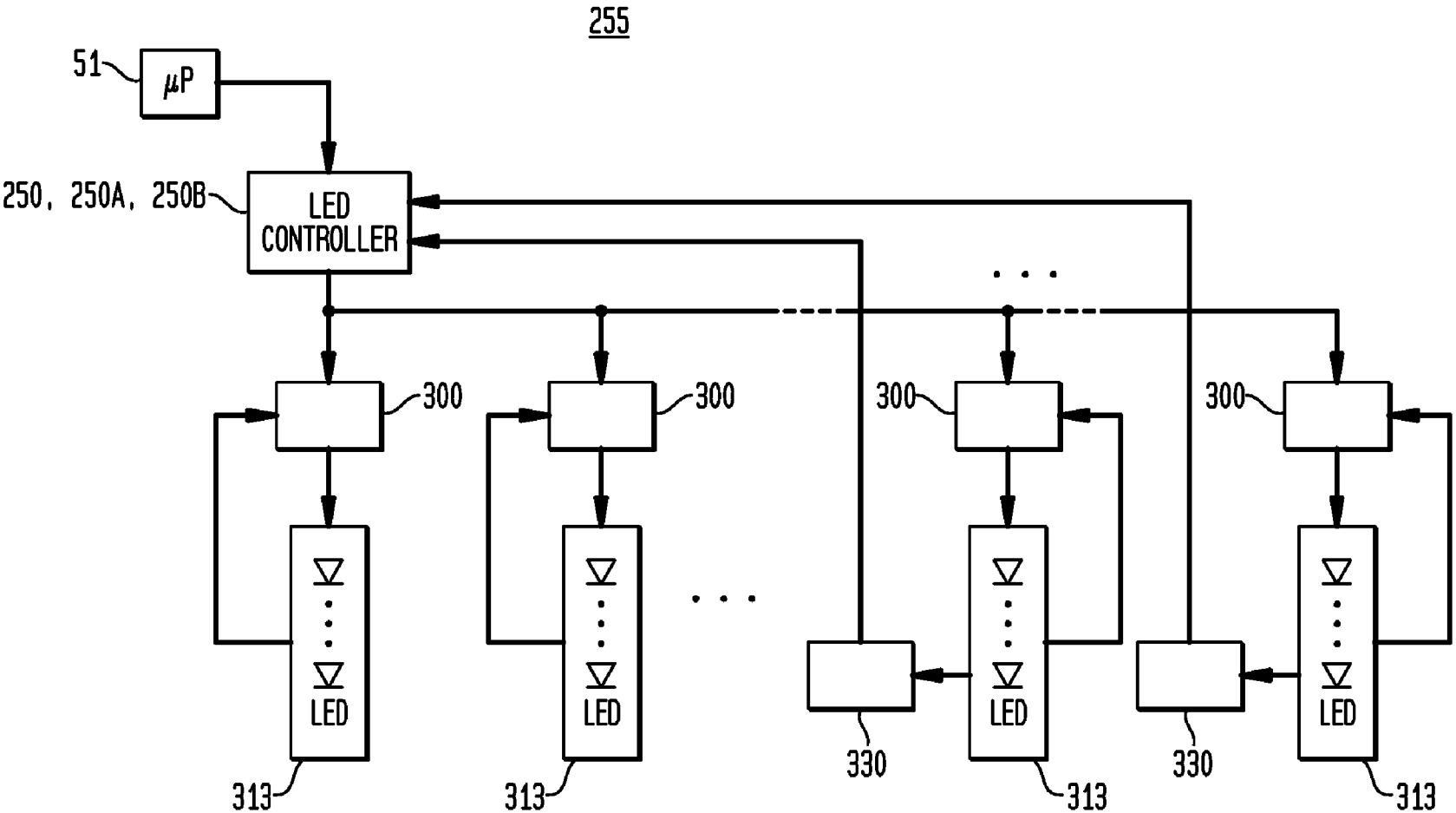
FIG. 26 is a block diagram of a representative sixth system embodiment in accordance with the teachings of the present disclosure.
Figure 27:
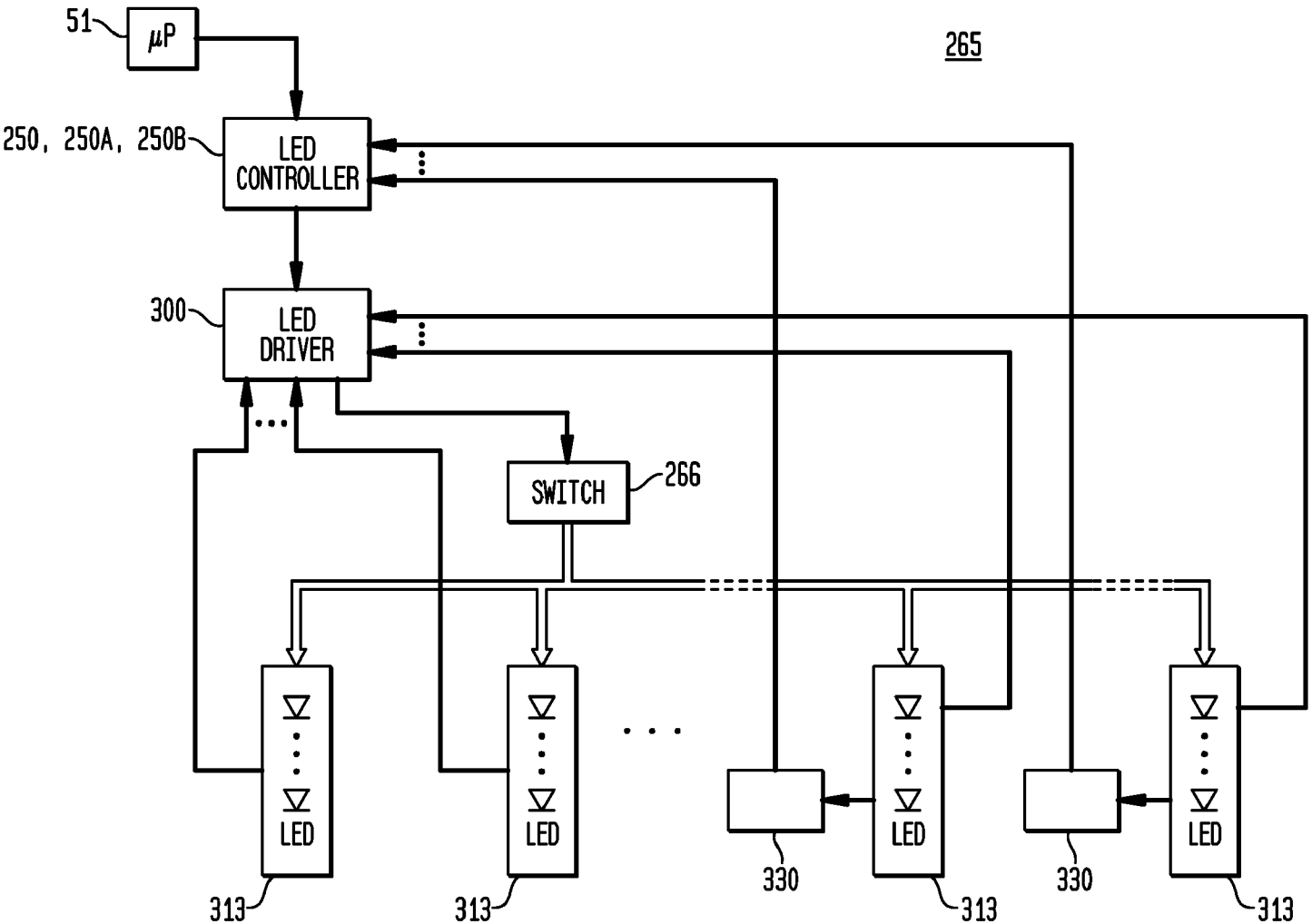
FIG. 27 is a block diagram of a representative seventh system embodiment in accordance with the teachings of the present invention.

FIG. 23 is a block diagram of a representative third system 225 embodiment in accordance with the teachings of the present disclosure. FIG. 24 is a block diagram of representative fourth system 235 embodiment in accordance with the teachings of the present disclosure. FIG. 25 is a block diagram of a representative fifth system 245 embodiment in accordance with the teachings of the present disclosure. FIG. 26 is a block diagram of a representative sixth system 255 embodiment in accordance with the teachings of the present disclosure. FIG. 27 is a block diagram of a representative seventh system 265 embodiment in accordance with the teachings of the present disclosure. FIGS. 23, 24, 25 and 26 illustrate the extension of the previously discussed systems 200 and 210 into systems for operation of multiple arrays of LEDs 313, such as for independent control of an array of red LEDs 313, an array of blue LEDs 313, an array of green LEDs 313, etc., with a separate LED controller 250, 250A, 250B, a separate temperature sensor 330, and a separate LED driver 300 for each corresponding array to be separately controlled.

FIG. 26 illustrates the extension of the previously discussed systems 200 and 210 into systems for operation of multiple arrays of LEDs 313, such as for independent control of an array of red LEDs 313, an array of blue LEDs 313, an array of green LEDs 313, etc., with a separate temperature sensor 330, and a separate LED driver 300 for each corresponding array to be separately controlled, but using a common LED controller 250, 250A, 250B to provide such separate or independent control. Typically, such independent or separate control may be desirable when each array of LEDs 313 has a distinct or different emitted spectrum which should be controlled to achieve a selected effect, such as to provide the selected intensity level with an emitted spectrum which is perceived to be substantially constant or within a selected tolerance level. In other circumstances, other effects may also be achieved, such as to provide different color mixes at different intensity levels, etc.

FIG. 27 illustrates the extension of the previously discussed systems 200 and 210 into systems for operation of multiple arrays of LEDs 313, such as for independent control of an array of red LEDs 313, an array of blue LEDs 313, an array of green LEDs 313, etc., with a separate temperature sensor 330 for each corresponding array to be separately controlled, but using a common LED controller 250, 250A, 250B and a common LED driver 300 to provide such separate or independent control, using a switch 266, which provides the combined electrical biasing separately (and/or independently) to each array 313. In this embodiment, the system 265 configuration is advantageous because it utilizes a common LED driver 300 for each array, and also includes appropriate switching or multiplexing 266 to power multiple arrays of LEDs 313 separately and/or independently. Not separately illustrated, temperature sensors 330 may also be common to multiple arrays of LEDs 313. As mentioned above, such independent or separate control may be desirable when each array of LEDs 313 has a distinct or different emitted spectrum which should be controlled to achieve a selected effect, such as to provide the selected intensity level with an emitted spectrum which is perceived to be substantially constant or within a selected tolerance level. In other circumstances, other effects may also be achieved, such as to provide different color mixes at different intensity levels, etc.

As illustrated, systems 225, 235, 245, 255 also may be commonly controlled by a user, such as through a microprocessor 51, as previously discussed. Not separately illustrated, systems 225, 235, 245, 255 also may be separately controlled by a user, such as through a corresponding plurality of microprocessors 51 or any other user interfaces previously discussed.

FIGS. 23-27 also illustrate representative system 225, 235, 245, 255, 265 embodiments particularly suited for control of independent arrays of LEDs 313, which may have the same emission spectra or different emission spectra, such as being all of the same type of LEDs 313, or being different types of LEDs 313, such as red LEDs 313R, blue LEDs 313B, and green LEDs 313G illustrated specifically in FIG. 25, as a three-channel lighting system 240. Red LEDs 313R, blue LEDs 313B, and green LEDs 313G are powered by respective independent LED drivers 300 with separate, corresponding output time average currents, and with separate corresponding feedbacks, including temperature sensors 330 for providing feedback for adjusting the electrical biasing techniques to accommodate temperature changes, in addition to intensity changes. For system 245, each LED controller 250B (one per color channel) is individually addressed and coupled to the microprocessor 51 or other interface to independently regulate intensity of each array of LEDs connected in a channel and to control wavelength emission shift at the same time, while system 255 utilizes a common LED controller 250, 250A, or 250B.

Referring to FIG. 25, for the red LEDs 313R, the wavelength shift of a red InGaN LED in response to changes in intensity, for example, is compensated by controlling the temperature of the p-n junction. In accordance with the representative embodiment, this is highly desirable because such types of red LEDs do not necessarily exhibit opposing wavelength shifts from different biasing techniques. In the system 245, therefore, the red channel LEDs 313R have an active electrodynamic cooling element 362 (based on the Peltier effect), which would be coupled to a heat sink (not separately illustrated) of the array of red LEDs 313R. The cooling element 362 is powered by a buffer 164 supplying DC current to the cooling element 362, which in turn is regulated by an error amplifier 363 coupled with its negative terminal to the feedback provided by the temperature sensor 330 and with its positive terminal coupled to a temperature reference signal provided by the corresponding red channel LED controller 250B. In order to regulate the wavelength shift of the red LED emission, such as to maintain the red spectrum substantially constant or within a selected tolerance, the corresponding red channel LED controller 250B will effectively maintain the p-n junction temperature substantially constant or within a selected tolerance. In the event that the ambient temperature is too high and the cooling element 362 cannot provide sufficient cooling, additional circuitry (e.g., to detect a threshold temperature from the temperature sensor 130) (not separately illustrated) will provide a signal to the corresponding red channel LED controller 250B, which may then reduce the intensity of the red LEDs 313R directly, or direct the microprocessor 51 to reduce the intensity of the entire system 240, to thereby bring the junction temperature back to below a threshold value. Not separately illustrated, the other types of LEDs, such as the green LEDs 313G and blue LEDs 313B, may also be provided with similar cooling elements 362 and associated circuitry 363, 364.

There are innumerable ways to implement the representative apparatuses 250, 250A, 250B and systems 225, 235, 245, 255 to perform the methodology of the present disclosure, any and all of which are considered equivalent and within the scope of the disclosure.

In summary, representative embodiments of the disclosure provide an illumination control method for lighting systems comprising at least one first LED or one first plurality of identical LEDs with at least first emission having a first spectrum and at least one second LED or one second plurality of identical LEDs with at least second emission having a second spectrum different from the first. Each LED p-n junction is biased with a combined or alternative time averaging technique to achieve the desired variation of intensity having wavelength emission shifts within a selected tolerance or substantially negligible, without using wavelength sensors or optical feedback signals to control the wavelength emissions. Each of the at least first LED or one first plurality of identical LEDs and each of the at least second LED or second plurality of identical LEDs may have separate LED drivers 300, with a first LED driver associated with the first LED or first plurality of identical LEDs and a second LED driver associated with the second LED or second plurality of identical LEDs. The first and second LED drivers are totally independent and capable of receiving unique input signals to execute time averaging drive of said LED(s) with combined or alternative biasing techniques. For a lighting system utilizing different color LEDs, for example, this method improves the quality of illumination produced by the lighting system, such as by providing stable chromaticity coordinates and color temperature for a white light lighting system, or stable color mixing at different intensities for a color lighting system.

The execution of the method is divided into two stages as mentioned above, a preoperational stage and an operational stage. The preoperational stage starts with the selecting of biasing techniques to vary output intensity for a given technology LED, as discussed above. At least two techniques should be selected to provide an optimal or satisfactory fit to regulate the intensity of each at least one first LED or one first plurality of identical LEDs with at least first emission having a first spectrum and at least one second LED or one second plurality of identical LEDs with at least second emission having a second spectrum different from the first. Each of these techniques should have an opposite wavelength shift in response to intensity variation. The next preoperational step is a statistical characterization of the dependence of wavelength emission drift of each different LED device type as a function of intensity conditions, as illustrated in FIGS. 1-3, for example. After having quantitatively identified both biasing techniques of an LED device, the next preoperational step is theoretically predicting a mixing of these techniques to achieve the desired effect on wavelength emission at intensity variations. The theoretical prediction may be done in the form of look up tables, linearized equations or any other form suitable to be stored as operational parameters (peak values, average levels, duty ratio, frequency and others) versus intensity levels and junction temperature, and retrieved from the memory, to execute the theoretical prediction. The preoperational stage ends with a step of storing the predicted theoretical combination of mixing biasing techniques into a controller memory separately for at least one first LED or one first plurality of identical LEDs with at least first emission having a first spectrum and for at least one second LED or one second plurality of identical LEDs with at least second emission having a second spectrum different from the first.

The operational stage, to be executed in real time, starts with a step of acquiring an input signal, e.g., addressed to particular first and second LED controllers, from optionally a lighting system microprocessor, remote controller, phase modulation of AC input voltage controller, manual controller, network controller and any other means of communicating to an LED controller the requested level of intensity of the at least one first LED or one first plurality of identical LEDs with at least first emission and at least one second LED or one second plurality of identical LEDs with at least second emission having a second spectrum different from the first. Then, corresponding to the first and second intensity, the first and second operational parameters are retrieved from the memory of the first and second controllers. The retrieved operational parameters are converted into first and second control signals specifically associated with the LED driver technology (or type) and/or the technology (or type) for the selected at least one first LED or one first plurality of identical LEDs and the at least one second LED or one second plurality of identical LEDs drivers (cycle times, on times, off times, peak values set, average values set and others). The next step is the execution of the first and second control signals in the first and second LED drivers to adjust drive conditions to vary the LED biasing, as a function of intensity and/or junction temperature, and producing the desired condition of LEDs intensity with a combined or alternating time averaging modulation of at least one first LED or one first plurality of identical LEDs and at least one second LED or one second plurality of identical LEDs forward current or voltage. The input control signals are being monitored (at times monitored at all times) independently and operational parameters are adjusted to vary the desired intensity with the controlled LED spectrum.

In order to reduce flickering as the intensity level changes, the lighting system includes at least one first frame synchronization register associated with the first controller of at least first LED or one first plurality of identical LEDs to store the first input electrical biasing control signals and at least one second frame synchronization register associated with the second controller of at least second LED or one second plurality of identical LEDs to store the second input electrical biasing control signals. The first synchronized register is updated with new first control signals beginning at each frame, a fixed period of time, providing synchronization to the switching frequency. The second synchronized register is updated with new second control signals beginning at each frame, also providing synchronization to the switching frequency.

Also in summary, an illumination control method for a lighting system which comprises at least one first LED or a first plurality of identical LEDs with at least a first emission having a first spectrum and at least one second LED or a second plurality of identical LEDs with at least a second emission having a second spectrum different from the first spectrum. The illumination method comprises: (a) preselecting at least two alternative, first and second techniques of electrical biasing of a p-n junction of at least one first LED or a first plurality of identical LEDs of particular technology for time averaging variation of intensity, with either biasing technique affecting the wavelength shift in opposite directions; (b) preselecting at least two alternative, first and second techniques of electrical biasing of a p-n junction of at least one second LED or a second plurality of identical LEDs of particular technology for time averaging variation of intensity, with either biasing technique affecting the wavelength shift in opposite directions; (c) statistically precharacterizing at least one first LED or one first plurality of identical LED devices wavelength shift for each selected first and second techniques as a function of the intensity conditions; (d) statistically precharacterizing at least one second LED or one second plurality of identical LED devices' wavelength shift for each selected first and second techniques as a function of the intensity conditions; (e) theoretically predicting the first combination of both biasing the first and second techniques and first operational parameters to control both intensity and wavelength shift for at least one first LED or one first plurality of identical LED devices; (f) theoretically predicting the second combination of both biasing the first and second techniques and second operational parameters to control both intensity and wavelength shift for at least one second LED or one second plurality of identical LED devices; (g) generating the predicted combination of first operational parameters in the form of first look up tables or first linearized theoretical equations and storing them in the first LED driver controller memory; and (h) generating the predicted combination of second operational parameters in the form of second look up tables or second linearized theoretical equations and storing them in the second LED driver controller memory.

Continuing with the summary, the second part of the methodology comprises: (a) receiving via a lighting system addressable interface a first signal with the time scheduled intensity levels for at least one first LED or one first plurality of identical LEDs; (b) receiving via a lighting system addressable interface a second signal with the time scheduled intensity levels for at least one second LED or one second plurality of identical LEDs; (c) processing the received first signal of time scheduled intensity levels and retrieving from the first LED driver controller memory corresponding first operational parameters of electrical biasing techniques; (d) processing the received second signal of time scheduled intensity levels and retrieving from the second LED driver controller memory corresponding second operational parameters of electrical biasing techniques; (e) processing first operational parameters into first input electrical biasing control signals applied to first LED driver; (f) processing second operational parameters into second input electrical biasing control signals applied to second LED driver; (g) independently controlling at least a first intensity of the first regulated emission wavelength shift and a second intensity of the second regulated emission wavelength shift; and (h) executing electrical biasing of p-n junctions of at least one first LED or one first plurality of identical LEDs and at least one second LED or one second plurality of identical LEDs with combined or alternative time averaging of the first analog and the second pulse modulation techniques of forward current variation to control at least the first intensity of the first emission and the second intensity of the second emission.

The electrical biasing may be a forward current or a voltage across LED. The first analog technique of the forward current modulation may be an average DC current of the any waveform of the analog current control, and the second a pulse modulation technique of the forward current variation, such as a time averaged current of a pulse modulated current such as Pulse width modulation (PWM), pulse frequency modulation (PFM), pulse amplitude modulation (PAM) and other time averaged pulse modulated currents. The combined or alternative biasing technique may be implemented such that at least one potentially possible flicker of the optical output in at least the first emission and the second emission is reduced.

When the lighting system has separate first and second LED drivers associated with each of the at least first LED or one first plurality of identical LEDs and each of the at least second LED or second plurality of identical LEDs, the representative method further includes: controlling the intensity of the at least one first LED or first plurality of identical LEDs with the first independent LED driver with a combined or alternative biasing technique without significant wavelength emission shift, and controlling the intensity of the at least one second LED or second plurality of identical LEDs with the second LED driver with a combined or alternative biasing technique, also without significant wavelength emission shift, for example. The method may also include independently controlling at least the first intensity of the first emission without significant wavelength shift of the emission and the second intensity of the second emission without significant wavelength shift: (1) so as to regulate overall color generated by the lighting system, (2) so that an overall color generated by the lighting system represents a sequence of a single color emitted at a given time, (3) so as to dim the intensity of the lighting system, (4) so as to produce a dynamic lighting effect as requested by the interface signal, and/or (5) so as to produce a light with the regulated color temperature.

When the lighting system includes at least one first frame synchronization register associated with the first controller of at least first LED or one first plurality of identical LEDs to store the first input electrical biasing control signals, and at least one second frame synchronization register associated with the second controller of at least second LED or one second plurality of identical LEDs to store the second input electrical biasing control signals, then the step of processing first operational parameters into first input electrical biasing control signals applied to the first LED drive further includes updating the first synchronized register with new first control signals beginning at each fixed period of time synchronized to the switching frequency; and the step of processing second operational parameters into second input electrical biasing control signals applied to the second LED drive further includes updating the second synchronized register with new second control signals beginning at each fixed period of time synchronized to the switching frequency.

As mentioned above, FIG. 3 illustrates the peak wavelength as a function of junction temperature for red and green InGaN LED. For the green LED (FIG. 3B) the peak wavelength under PWM operations is proportional to the junction temperature. Similar results were observed for other InGaN LEDs, and there may be different mechanisms contributing to peak wavelength shift for CCR and PWM dimming. It has been suggested that band filling and QCSE seem to dominate the spectrum shift for CCR operation, while heat becomes the main contributor for spectrum shift for PWM operation. Accordingly, for another embodiment of the disclosure, the spectrum shift at the change of the junction temperature can be compensated for using the same method as described above. Advantageously, the intensity of LED may be changed using alternative electrical biasing techniques of the p-n junction of the LED, while keeping wavelength emission shift substantially close to zero or otherwise within tolerance, while the junction temperature is changing. The method of maintaining LED intensity constant with spectrum changes compensation caused by changes of junction temperature also has a preoperational stage and operational stage, as described above, but including the wavelength shifts resulting from changes injunction temperature, and typically also resulting from the at least two combined or alternative biasing techniques, which should have an opposite wavelength shift at junction temperatures changes (PWM and CCR on FIG. 3B). A statistical characterization of dependence of a wavelength emission drift of LED devices as a function of junction temperature is also performed, as illustrated in FIG. 3, followed by theoretically predicting the mixing of these techniques to achieve the desired spectrum change substantially close to zero or otherwise within tolerance at any given junction temperature. The theoretical prediction may be done in the form of look up tables, linearized equations or any other form suitable to be stored as operational parameters (peak values, average levels, duty ratio, frequency, and others) and retrieved from the memory to execute the theoretical prediction. The preoperational stage ends with a step of storing the predicted theoretical combination of mixing biasing techniques into controller memory.

The operational stage, also executed in real time, starts with acquiring a junction temperature of an LED. It can be done by measuring temperature of the junction itself or measuring ambient temperature or case and calculating junction temperature based on losses inside LED and thermal characteristics of the heat sink. Operational parameters corresponding to the junction temperature are retrieved from the memory 220 of the LED controller. In the next step, the retrieved operational parameters are converted into control signals specifically associated with technology of selected LED drivers (cycle times, on times, off times, peak values set, average values set, and others). The last step is an execution of control signals in the LED drivers to adjust drive conditions to the junction temperature, while maintaining the same intensity such as the spectrum of LED emission remains substantially unchanged or otherwise within tolerance. The method continues, with monitoring the p-n junction of LED and acquiring its temperature to adjust the spectrum at constant LED intensity.

The representative method of varying the intensity (dimming) of at least a single LED or a plurality of identical LEDs with the emission wavelength control and the method of maintaining constant the intensity of at least of a single LED or a plurality of identical LEDs with compensation for spectrum changes caused by changes of LED junction temperature, either could be used independently as described above, and also used in combination, to vary the intensity without significant wavelength emission shift and at the same time compensating for any wavelength shift due to junction temperature changes. In these circumstances for control over spectrum changes due to intensity and temperature variation, the methodology is also divided into two stages, preoperational and operational, as described above, with the statistical characterization and parameter creation based upon determining wavelength shift as a function of both temperature and intensity variation (using different biasing techniques), or by superimposing separate determinations of wavelength shift as a function of temperature and as a function of intensity variation (and biasing technique). After having quantitatively identified both biasing techniques of an LED device for temperature compensation, then the temperature compensation may be superimposed on intensity variation by readjustment of the theoretically predicted mixture of the first and second biasing techniques to achieve the desired spectrum change substantially close to zero or otherwise within tolerance at any giving intensity and junction temperature. The adjusted theoretical prediction may be done in the form of look up tables, linearized equations or any other form suitable to be stored as operational parameters (peak values, average levels, duty ratio, frequency and others) versus intensity levels and junction temperature and retrieved from the memory to execute the theoretical prediction. For each given discrete value of intensity (100%, 90%, . . . 10%) there will be its matching look up table of opposite biasing signals as a function of junction temperature. These operational parameters are then utilized subsequently, as described above, using the additional input of a sensed, acquired or calculated junction temperature. Corresponding control signals will then be provided to the LED drivers to adjust drive conditions to the junction temperature and produce the desired condition of LED intensity with a combined or alternative time averaging modulation of LED forward current. The input control signals and the junction temperature is being monitored independently and operational parameters are adjusted to compensate for any changes in junction temperature or to vary the desired intensity with the controlled LED spectrum.

The methodology may also include combining non-zero signals of said first and second biasing techniques for the purpose of regulating wavelength emission while still maintaining the same averaged LED intensity and, instead, controlling the wavelength changes which could result from changes in LED junction temperature. Various systems 225, 235, 245, 255 have also been described, which execute the operational portion of the method, as described above, and may utilized separate and independent apparatuses 250, 250A, 250B (LED controllers) for each LED channel, and/or separate LED drivers 300, or may provide combined control, such as illustrated in FIG. 26.

In a representative embodiment, at least one LED controller 250, 250A, 250B includes at least: one first dimming frame register, one first intensity register, one first programmable look up table memory, one first programmable frame counter and cycle counter, one first block of operational signal registers, three analog multiplexers and two digital-to-analog converters and wherein the said first controller is structured to program the first operational signal registers, with at least two first peak current amplitude registers, two first current amplitude modulation registers and two first current duty cycle registers, with the first operational signals presenting combined or alternative first and the second biasing techniques complying with the intensity levels and emission wavelength control specified by a user interface. Additional second, third, etc., LED controllers 250, 250A, 250B may be similarly configured.

In these representative embodiments, the at least one first controller is structured to vary the intensity of at least one first LED or first plurality of identical LEDs with negligible corresponding optical output flickering by alternatively multiplexing of the first operational signals to the first LED driver from a current set of the first operational signal registers synchronously to the end of current first dimming frame counter, while programming asynchronously the second set of the first operational signal registers with the new first operational signals and putting them in a queue to change their status to current at the end of the next first dimming frame counter. This is also extendable to multiple channels, as discussed above.

In addition, various systems may include at least three different LEDs, wherein at least one first LED or first plurality of LEDs are red LEDs, at least one second LED or second plurality of LEDs are green LEDs, and at least one third LED or third plurality of LEDs are blue LEDs. Such a lighting system with variable intensity and wavelength emission control with red, green, and blue LEDs may further include: an electrodynamic cooling element connected to a heat sink of a single red or plurality of red LEDs; a red LED temperature sensor coupled to the heat sink and connected to the negative terminal of a junction temperature regulator, the positive terminal of which is connected to the temperature set reference voltage source in the red LED controller; and a buffer connected to the output of red LED junction temperature regulator and supplying DC current to the cooling element to regulate the junction temperature of the red LED. The red LED temperature sensor is coupled to the red LED controller to regulate the intensity of LEDs when the red LED junction temperature is above a predetermined or set value.

In the inventive lighting systems with variable intensity and wavelength emission control, the power converter(s) generally is or are a linear circuit with the time averaging modulation of forward current conforming with first input control signals to vary intensity of first LED within dimming cycle by implementing two alternative biasing techniques to drive the LED, while maintaining the wavelength emission shift substantially close to zero or otherwise within tolerance. The power converter may be a switching DC/DC circuit, or a switching AC/DC circuit, generally with a power factor correction circuit. The input power signal may be an AC utility signal, or may be an AC utility signal that is coupled to phase modulation device (wall dimmer). In addition, the lighting system with variable intensity and wavelength emission control may also comprise an enclosure compatible with the standard bulb interface, such as an Edison socket.

Also in summary, the representative embodiments of the present disclosure also provide an illumination control method to vary the intensity of a lighting system comprising at least one first LED or a first plurality of identical LEDs with a first emission having a first spectrum and at least one second LED or a second plurality of identical LEDs with a second emission having a second spectrum different from the first spectrum, and having separate LED drivers, namely, a first LED driver associated with the first LED or first plurality of identical LEDs and a second LED driver associated with the second LED or second plurality of identical LEDs. The representative method provides compensation for spectrum changes caused by changes of LED junction temperature. The representative method is divided into at least two parts, with a first, preoperational part comprising: (a) selecting at least the first and second combined or alternative techniques of electrical biasing of a p-n junction of at least one first LED or a first plurality of identical LED devices of a particular technology for time averaging variation of intensity, with the selected said biasing techniques varying LED intensity (dimming) such that either one affects wavelength shifts in opposite directions as the junction temperature changes; (b) selecting at least the first and second combined or alternative techniques of electrical biasing of a p-n junction of at least one second LED or a second plurality of identical LED devices of a particular technology for time averaging variation of intensity, with the selected said biasing techniques varying LED intensity (dimming) such that either one affects wavelength shifts in opposite directions as the junction temperature changes; (c) statistically characterizing the at least one first LED or first plurality of identical LED devices for wavelength shift for each selected technique as a function of the intensity conditions and statistically characterizing the at least one first LED or first plurality of identical LED devices for wavelength shift for each selected technique as a function of the junction temperature; (d) statistically characterizing the at least one second LED or second plurality of identical LED devices for wavelength shift for each selected technique as a function of the intensity conditions and statistically characterizing the at least one second LED or second plurality of identical LED devices for wavelength shift for each selected technique as a function of the junction temperature; (e) theoretically predicting a first combination of both biasing techniques to control both intensity and wavelength shift and concurrently compensating wavelength shift for junction temperature change of the at least one first LED or first plurality of identical LED devices; (f) theoretically predicting a second combination of both biasing techniques to control both intensity and wavelength shift and concurrently compensating wavelength shift for junction temperature change of the at least one second LED or second plurality of identical LED devices; (g) storing said predicted first combination in the memory of the first LED controller (to be used by the corresponding first LED driver); and (h) storing said predicted second combination in the memory of the second LED controller (to be used by the corresponding second LED driver).

The second operational portion of the representative method comprises: (a) monitoring an input control signal to set or select the desired intensity of the at least one first LED or first plurality of identical LED devices, with the input control signal being generated optionally by a lighting controller, a microprocessor, a remote controller, an AC phase modulation controller, or any manual controller, and the control input signal may be in any analog or digital form compatible with the input/output interface for the controller for the LED driver; (b) monitoring an input control signal to set or select the desired intensity of the at least one second LED or second plurality of identical LED devices, with the input control signal being generated optionally by a lighting controller, a microprocessor, a remote controller, an AC phase modulation controller or any manual controller, and the control input signal may be in any analog or digital form compatible with the input/output interface for the controller for the LED driver; (c) monitoring a p-n junction of at least one first LED or first plurality of identical LED devices and acquiring or determining its first junction temperature; (d) monitoring a p-n junction of the at least one second LED or second plurality of identical LED devices and acquiring or determining its second junction temperature; (e) using said first input control signal and first p-n junction temperature to retrieve from the memory the stored first combination of biasing techniques (making iterations if desired) and the first operational parameters of application of biasing techniques conforming to the first input control signals and first p-n junction temperature of the at least one first LED or first plurality of identical LED devices; (f) using said second input control signal and second p-n junction temperature to retrieve from the memory the stored second combination of biasing techniques (making iterations if desired) and the second operational parameters of application of biasing techniques conforming to the second input control signals and second p-n junction temperature of the at least one second LED or second plurality of identical LED devices; (g) processing the first operational parameters into first input electrical biasing control signals for application to the first LED driver; (h) processing the second operational parameters into second input electrical biasing control signals for application to the second LED driver; (i) operating the first LED driver with the time averaging modulation of forward current conforming to the first input electrical biasing control signals to vary the intensity of the at least one first LED or first plurality of identical LED devices while controlling wavelength emission and compensating it for p-n junction temperature change; and (j) operating the second LED driver with the time averaging modulation of forward current conforming to the second input electrical biasing control signals to vary the intensity of the at least one second LED or second plurality of identical LED devices while controlling wavelength emission and compensating it for p-n junction temperature change.

As mentioned above, the electrical biasing may be a forward current or a voltage across the LED(s). In addition, the first biasing technique may be an adaptation of an average DC current of the any waveform of the analog current control, and the second biasing technique may be an adaptation of a pulse modulated current such as pulse width modulation (PWM), pulse frequency modulation (PFM), pulse amplitude modulation (PAM), and other time averaged pulse modulated currents. The method may also include combining non-zero signals of said first and second biasing techniques for the purpose of regulating wavelength emission while still maintaining the same average LED intensity.

The theoretical prediction of the combination of both techniques to control both intensity and wavelength shift, including with temperature compensation, may provide that such wavelength shift is substantially without wavelength shift, or substantially close to zero, or otherwise within a predetermined tolerance. For example, the method may also include independently controlling at least the first intensity of the first emission without substantial wavelength shift and the second intensity of the second emission without substantial wavelength shift so as to regulate the overall color generated by the lighting system, or so that an overall color generated by the lighting system represents a sequence of a single color emitted at a given time, or so as to dim the output of the lighting system, or so as to produce a dynamic lighting effect as requested by the interface signal.

Numerous advantages of the present disclosure for providing power to solid state lighting, such as light emitting diodes, are readily apparent. The representative embodiments allow for energizing one or more LEDs, using a combination of forward biasing techniques, which allow for both regulating the intensity of the emitted light while controlling the wavelength emission shift, from either or both the LED response to intensity variation (dimming technique) and due to p-n junction temperatures changes. In addition, this intensity control, with simultaneous control of the emitted spectrum, is achieved without using an expensive optical feedback system. Yet another advantage of the representative embodiments of the disclosure is increased depth of dimming while maintaining the emitted spectrum substantially constant or within a selected tolerance, because the overall or ultimate biasing is proportional to the product of variations of alternative single biasing techniques. For example, a 1:10 pulse frequency modulation and 1:10 pulse amplitude modulation may produce a 1:100 dimming. In addition, the representative embodiments of the disclosure also provide for varying intensity while simultaneously reducing the EMI produced by lighting systems, especially because current steps in the pulse modulation are dramatically reduced or eliminated completely. The representative LED controllers are also backwards-compatible with legacy LED control systems, frees the legacy host computer for other tasks, and allows such host computers to be utilized for other types of system regulation. The representative current regulator embodiments provide digital control, without including external compensation. The representative current regulator embodiments also utilize comparatively fewer components, providing reduced cost and size, while simultaneously providing increased efficiency and enabling longer battery life when used in portable devices.

Although the disclosure has been described with respect to specific embodiments thereof, these embodiments are merely illustrative and not restrictive of the disclosure. In the description herein, numerous specific details are provided, such as examples of electronic components, electronic and structural connections, materials, and structural variations, to provide a thorough understanding of embodiments of the present disclosure. An embodiment of the disclosure can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present disclosure. In addition, the various Figures are not drawn to scale and should not be regarded as limiting.

Reference throughout this specification to "one embodiment," "an embodiment," or a specific "embodiment" means that a particular feature, structure, or characteristic described in connection with the embodiment is included in at least one embodiment of the present disclosure and not necessarily in all embodiments, and further, are not necessarily referring to the same embodiment. Furthermore, the particular features, structures, or characteristics of any specific embodiment of the present disclosure may be combined in any suitable manner and in any suitable combination with one or more other embodiments, including the use of selected features without corresponding use of other features. In addition, many modifications may be made to adapt a particular application, situation or material to the scope and spirit of the claimed subject matter. It is to be understood that other variations and modifications of the embodiments of the present disclosure described and illustrated herein are possible in light of the teachings herein and are to be considered part of the spirit and scope of the claimed subject matter.

It will also be appreciated that one or more of the elements depicted in the Figures can also be implemented in a more separate or integrated manner, or even removed or rendered inoperable in certain cases, as may be useful in accordance with a particular application. Integrally formed combinations of components are also within the scope of the claimed subject matter, particularly for embodiments in which a separation or combination of discrete components is unclear or indiscernible. In addition, use of the term "coupled" herein, including in its various forms such as "coupling" or "couplable," means and includes any direct or indirect electrical, structural or magnetic coupling, connection or attachment, or adaptation or capability for such a direct or indirect electrical, structural or magnetic coupling, connection or attachment, including integrally formed components and components which are coupled via or through another component.

As used herein for purposes of the present disclosure, the term "LED" and its plural form "LEDs" should be understood to include any electroluminescent diode or other type of carrier injection- or junction-based system which is capable of generating radiation in response to an electrical signal, including without limitation, various semiconductor- or carbon-based structures which emit light in response to a current or voltage, light emitting polymers, organic LEDs, and so on, including within the visible spectrum, or other spectra such as ultraviolet or infrared, of any bandwidth, or of any color or color temperature.

Furthermore, any signal arrows in the drawings/Figures should be considered only representative, and not limiting, unless otherwise specifically noted. Combinations of components of steps will also be considered within the scope of the present disclosure, particularly where the ability to separate or combine is unclear or foreseeable. The disjunctive term "or," as used herein and throughout the claims that follow, is generally intended to mean "and/or," having both conjunctive and disjunctive meanings (and is not confined to an "exclusive or" meaning), unless otherwise indicated. As used in the description herein and throughout the claims that follow, "a", "an," and "the" include plural references unless the context clearly dictates otherwise. Also as used in the description herein and throughout the claims that follow, the meaning of "in" includes "in" and "on" unless the context clearly dictates otherwise.

The foregoing description of illustrated embodiments of the present disclosure, including what is described in the summary or in the abstract, is not intended to be exhaustive or to limit the disclosure to the precise forms disclosed herein. From the foregoing, it will be observed that numerous variations, modifications and substitutions are intended and may be effected without departing from the spirit and scope of the disclosure. It is to be understood that no limitation with respect to the specific methods and apparatus illustrated herein is intended or should be inferred. It is, of course, intended to cover by the appended claims all such modifications as fall within the scope of the claims.

It is claimed:

1. A method of controlling an intensity of light emitted from a solid state lighting system, the method comprising:

receiving information designating a selected intensity level lower than a full intensity level, wherein the solid state lighting system is configured to have a first emitted spectrum at the full intensity level, wherein a first electrical biasing for the solid state lighting system produces a first wavelength shift, and wherein a second electrical biasing for the solid state lighting system produces a second, opposing wavelength shift; and providing a combined first electrical biasing and second electrical biasing to the solid state lighting system to generate emitted light having the selected intensity level and having a second emitted spectrum within a predetermined variance of the first emitted spectrum.

2. The method of claim 1, wherein the combined first electrical biasing and second electrical biasing is a superposition of or an alternation between at least two of the following types of electrical biasing: pulse width modulation, constant current regulation, pulse frequency modulation, and pulse amplitude modulation.

3. The method of claim 1, wherein the combined first electrical biasing and second electrical biasing is configured to have a first duty cycle ratio of peak electrical biasing, a second duty cycle ratio of no forward biasing, and an average current level, wherein the first duty cycle ratio, the second duty cycle ratio, and the average current level are related to the selected intensity level according to a first relation of $$d = \frac{k_2}{1 + k_2} D$$

and a second relation of $$\alpha = \frac{d}{k_2(1 - d - \beta)},$$

in which variable "d" is the first duty cycle ratio, variable "α" is an amplitude modulation ratio corresponding to the average current level, variable "D" is a dimming ratio corresponding to the selected intensity level, variable "β" is the second duty cycle ratio, coefficient "$k_1$" is a linear coefficient less than one, and coefficient "$k_2$" is a ratio of averaged biasing voltage or current for wavelength compensation.

4. The method of claim 1, wherein the combined first electrical biasing and second electrical biasing is a superposition of the first electrical biasing and the second electrical biasing.

5. The method of claim 4, wherein the superposition of the first electrical biasing and the second electrical biasing is a predetermined parameter to produce the second emitted spectrum within the predetermined variance for the selected intensity.

6. The method of claim 4, wherein the combined first electrical biasing and second electrical biasing comprises a superposition of a symmetric or asymmetric AC signal on a DC signal having an average component.

7. The method of claim 4, wherein the combined first electrical biasing and second electrical biasing is configured to have a duty cycle and an average current level, and wherein the duty cycle and the average current level are parameters stored in a memory and correspond to the selected intensity level.

8. An apparatus for adjusting an intensity of light emitted from a solid state lighting system, the apparatus comprising:

an interface configured to receive information designating a selected intensity level lower than a full intensity level, wherein the solid state lighting system is configured to have a first emitted spectrum at the full intensity level, wherein a first electrical biasing for the solid state lighting system produces a first wavelength shift, and wherein a second electrical biasing for the solid state lighting system produces a second, opposing wavelength shift;

a memory configured to store a plurality of parameters corresponding to a plurality of intensity levels, wherein a parameter from the plurality of parameters corresponds to the selected intensity level; and a controller coupled to the memory, wherein the controller is configured to retrieve the parameter from the memory and to convert the parameter into a corresponding control signal to provide a combined first electrical biasing and second electrical biasing to the solid state lighting system to generate emitted light having the selected intensity level and having a second emitted spectrum within a predetermined variance of the first emitted spectrum.

9. The apparatus of claim 8, wherein the control signal is configured to provide the combined first electrical biasing and second electrical biasing as a superposition of the first electrical biasing and the second electrical biasing.

10. The apparatus of claim 8, wherein the control signal is configured to provide the combined first electrical biasing and second electrical biasing as superposition of a symmetric or asymmetric AC signal on a DC signal having an average component.

11. The apparatus of claim 8, wherein the plurality of parameters comprises a duty cycle parameter and an average current level parameter for the combined first electrical biasing and second electrical biasing.

12. The apparatus of claim 8, wherein the combined first electrical biasing and second electrical biasing is a superposition of or an alternation between at least two of the following types of electrical biasing: pulse width modulation, constant current regulation, pulse frequency modulation, and pulse amplitude modulation.

13. The apparatus of claim 8, wherein the combined first electrical biasing and second electrical biasing is configured to have a first duty cycle ratio of peak electrical biasing, a second duty cycle ratio of no forward biasing, and an average current level, wherein the first duty cycle ratio, the second duty cycle ratio, and the average current level are related to a selected intensity level according to a first relation of $$d = \frac{k_2}{1 + k_2} D$$

and a second relation of $$\alpha = \frac{d}{k_2(1 - d - \beta)},$$

in which variable "d" is the first duty cycle ratio, variable "α" is an amplitude modulation ratio corresponding to the average current level, variable "D" is a dimming ratio corresponding to the selected intensity level, variable "β" is the second duty cycle ratio, coefficient "$k_1$" is a linear coefficient less than one, and coefficient "$k_2$" is a ratio of averaged biasing voltage or current for wavelength compensation.

14. The apparatus of claim 8, wherein the solid state lighting system comprises a plurality of arrays of light emitting diodes, and wherein at least three arrays from the plurality of arrays of light emitting diodes have corresponding emission spectra of different colors.

15. A solid state lighting system, comprising:

a plurality of arrays of light emitting diodes having a first emitted spectrum at a full intensity level, a first electrical biasing for an array from the plurality of arrays producing a first wavelength shift, and a second electrical biasing for the array from the plurality of arrays producing a second, opposing wavelength shift;

a plurality of driver circuits, wherein each driver circuit is coupled to a corresponding array from the plurality of arrays of light emitting diodes;

an interface configured to receive information designating a selected intensity level lower than the full intensity level;

a memory configured to store a plurality of parameters corresponding to a plurality of intensity levels, wherein a parameter from the plurality of parameters corresponds to the selected intensity level; and a controller coupled to the memory and to a first driver circuit from the plurality of driver circuits, wherein the controller is configured to retrieve the parameter from the memory and to convert the parameter into a corresponding control signal to the first driver circuit to provide a combined first electrical biasing and second electrical biasing to the corresponding array to generate emitted light having the selected intensity level and having a second emitted spectrum within a predetermined variance of the first emitted spectrum.

16. The system of claim 15, wherein the second emitted spectrum is one of an overall color generated within the predetermined variance, a sequence of a single color emitted at a given time, or a dynamic lighting effect as requested by a second signal received by the interface.

17. The system of claim 15, wherein the control signal is configured to provide the combined first electrical biasing and second electrical biasing as a superposition of or an alternation between at least two of the following types of electrical biasing: pulse width modulation, constant current regulation, pulse frequency modulation, and pulse amplitude modulation.

18. The system of claim 15, wherein the plurality of parameters comprises a duty cycle parameter and an average current level parameter for the combined first electrical biasing and second electrical biasing.

19. The system of claim 15, wherein the controller is configured to synchronize the control signal with a switching cycle of the first driver circuit.

20. A computer-readable storage medium having instructions stored thereon that, in response to execution by a computing device, cause the computing device to:

receive information designating a selected intensity level lower than a full intensity level for a solid state lighting system, wherein the solid state lighting system is configured to have a first emitted spectrum at the full intensity level;

generate a first electrical biasing for the solid state lighting system, wherein the first electrical biasing produces a first wavelength shift;

generate a second electrical biasing for the solid state lighting system, wherein the second electrical biasing produces a second, opposing wavelength shift; and provide a combined first electrical biasing and second electrical biasing to the solid state lighting system to generate emitted light having the selected intensity level and having a second emitted spectrum within a predetermined variance of the first emitted spectrum.

21. A computer-readable storage medium having instructions stored thereon that, in response to execution by a computing device, cause the computing device to:

receive information designating a selected intensity level lower than a full intensity level for a solid state lighting system, wherein the solid state lighting system is configured to have a first emitted spectrum at the full intensity level;

generate a first electrical biasing for the solid state lighting system, wherein the first electrical biasing produces a first wavelength shift;

generate a second electrical biasing for the solid state lighting system, wherein the second electrical biasing produces a second, opposing wavelength shift;

store a plurality of parameters corresponding to a plurality of intensity levels for the solid state lighting system, wherein a parameter from the plurality of parameters corresponds to the selected intensity level; and convert the parameter into a corresponding control signal that causes a combined first electrical biasing and second electrical biasing to be provided to the solid state lighting system to generate emitted light having the selected intensity level and having a second emitted spectrum within a predetermined variance of the first emitted spectrum.

* * * * *